US012422220B2

(12) United States Patent
Tayon et al.

(10) Patent No.: US 12,422,220 B2
(45) Date of Patent: Sep. 23, 2025

(54) ELECTRONIC FIREARM ACCESSORY WITH LIGHT SOURCE

(71) Applicant: Crimson Trace Corporation, Columbia, MO (US)

(72) Inventors: James Tayon, Moberly, MO (US); Matthew Kinamore, Columbia, MO (US); James Gianladis, Harrisburg, MO (US); Michael Cottrell, Columbia, MO (US); Tim Kinney, Warrenton, MO (US); Dennis W. Cauley, Jr., Booneville, MO (US); Mark Dalton, Columbia, MO (US); Justin Burke, Columbia, MO (US); Anthony Vesich, Columbia, MO (US); Yu King Wai, Kowloon (HK)

(73) Assignee: Crimson Trace Corporation, Columbia, MO (US)

( * ) Notice: Subject to any disclaimer, the term of this patent is extended or adjusted under 35 U.S.C. 154(b) by 0 days.

(21) Appl. No.: 18/351,822

(22) Filed: Jul. 13, 2023

(65) Prior Publication Data

US 2023/0366657 A1 Nov. 16, 2023

Related U.S. Application Data

(63) Continuation of application No. 17/389,787, filed on Jul. 30, 2021, now Pat. No. 11,788,816, which is a continuation of application No. 15/941,971, filed on Mar. 30, 2018, now Pat. No. 11,105,586.

(51) Int. Cl.
*F41G 1/35* (2006.01)
*F41G 11/00* (2006.01)

(52) U.S. Cl.
CPC ..... *F41G 1/35* (2013.01); *F41G 11/003* (2013.01)

(58) Field of Classification Search
CPC ..... F21V 23/0414; F21V 23/0421; F21V 23/0428; F41G 11/003; F41G 11/34; F41G 11/35; F41G 11/36
See application file for complete search history.

(56) References Cited

U.S. PATENT DOCUMENTS 3,579,840 A 5/1971 Heinzel
4,688,345 A 8/1987 Kilgour
4,697,226 A 9/1987 Verdin
(Continued)

OTHER PUBLICATIONS

2001 Surefire WeaponLight Price List Catalog, Jan. 15, 2001, 13 pages.

(Continued)

*Primary Examiner* — Abdulmajeed Aziz
*Assistant Examiner* — Steven Y Horikoshi
(74) *Attorney, Agent, or Firm* — Stinson LLP

(57) ABSTRACT

Firearm accessories and associated methods. A firearm accessory includes a mount for mounting the firearm accessory on a firearm. The mount can be adjustable to customize the mounting of the firearm accessory on the firearm. Electronic firearm accessories can include a longitudinally extending circuit structure having one or more electronic switches thereon facing laterally. A switch assembly can include a push member and a finger extending therefrom for actuating an associated electronic switch. Battery compartment features are also disclosed.

26 Claims, 20 Drawing Sheets

(56) References Cited

U.S. PATENT DOCUMENTS

| | | | |
|---|---|---|---|
| 5,033,219 | A | 7/1991 | Johnson et al. |
| 5,179,235 | A | 1/1993 | Toole |
| 5,194,007 | A | 3/1993 | Marshall et al. |
| 5,237,773 | A | 8/1993 | Claridge |
| 5,400,540 | A | 3/1995 | Solinsky et al. |
| 5,430,967 | A | 7/1995 | Woodman, III et al. |
| 5,435,091 | A | 7/1995 | Toole et al. |
| 5,560,703 | A | 10/1996 | Capps, III |
| 5,581,898 | A | 12/1996 | Thummel |
| 5,584,137 | A | 12/1996 | Teetzel |
| 5,590,486 | A | 1/1997 | Moore |
| 5,618,099 | A | 4/1997 | Brubacher |
| 5,628,555 | A | 5/1997 | Sharrah et al. |
| 5,685,105 | A | 11/1997 | Teetzel |
| 5,706,600 | A | 1/1998 | Toole et al. |
| 5,758,448 | A | 6/1998 | Thummel |
| D398,410 | S | 9/1998 | Fell et al. |
| 5,913,669 | A | 6/1999 | Hansen et al. |
| 6,023,875 | A | 2/2000 | Fell et al. |
| 6,185,854 | B1 | 2/2001 | Solinsky et al. |
| 6,230,431 | B1 | 5/2001 | Bear |
| 6,276,088 | B1 | 8/2001 | Matthews et al. |
| 6,363,648 | B1 | 4/2002 | Kranich et al. |
| 6,378,237 | B1 | 4/2002 | Matthews et al. |
| 6,438,888 | B1 | 8/2002 | Lin et al. |
| 6,513,251 | B2 | 2/2003 | Huang et al. |
| 6,526,688 | B1 | 3/2003 | Danielson et al. |
| 6,571,503 | B2 | 6/2003 | Thorpe |
| 6,574,901 | B1 | 6/2003 | Solinsky et al. |
| 6,578,311 | B2 | 6/2003 | Danielson et al. |
| 6,606,813 | B1 | 8/2003 | Squire et al. |
| 6,609,810 | B2 | 8/2003 | Kim |
| 6,671,991 | B1 | 1/2004 | Danielson |
| 6,698,127 | B2 | 3/2004 | Weber |
| 6,705,038 | B2 | 3/2004 | Davenport et al. |
| 6,722,074 | B1 | 4/2004 | Farrell |
| 6,874,269 | B2 | 4/2005 | Chen et al. |
| D505,177 | S | 5/2005 | Fell et al. |
| 6,994,449 | B2 | 2/2006 | Kim |
| 7,117,624 | B2 | 10/2006 | Kim |
| 7,134,234 | B1 | 11/2006 | Makarounis |
| D536,116 | S | 1/2007 | Sharrah |
| 7,188,978 | B2 | 3/2007 | Sharrah et al. |
| 7,199,315 | B1 | 4/2007 | Sharrah et al. |
| 7,199,351 | B2 | 4/2007 | Toma |
| D543,446 | S | 5/2007 | DiNenna |
| D548,385 | S | 8/2007 | Sharrah et al. |
| 7,260,910 | B2 | 8/2007 | Danielson |
| 7,260,912 | B2 | 8/2007 | Liu |
| 7,264,369 | B1 | 9/2007 | Howe |
| 7,273,292 | B2 | 9/2007 | Kim |
| 7,310,903 | B2 | 12/2007 | Kim |
| 7,325,352 | B2 | 2/2008 | Matthews et al. |
| 7,332,682 | B2 | 2/2008 | Kim |
| D567,894 | S | 4/2008 | Sterling et al. |
| 7,360,333 | B2 | 4/2008 | Kim |
| D568,508 | S | 5/2008 | Howe et al. |
| D578,599 | S | 10/2008 | Cheng |
| 7,438,430 | B2 | 10/2008 | Kim |
| 7,441,918 | B2 | 10/2008 | Kim |
| D585,516 | S | 1/2009 | Smith |
| 7,472,830 | B2 | 1/2009 | Danielson |
| 7,493,722 | B2 | 2/2009 | Howe et al. |
| 7,523,583 | B2 | 4/2009 | Cheng |
| 7,591,098 | B2 | 9/2009 | Matthews et al. |
| D603,478 | S | 11/2009 | Hughes |
| 7,614,760 | B2 | 11/2009 | Sharrah et al. |
| D612,970 | S | 3/2010 | Sharrah et al. |
| 7,674,003 | B2 | 3/2010 | Sharrah et al. |
| 7,685,759 | B2 | 3/2010 | Teetzel |
| D616,957 | S | 6/2010 | Rievley et al. |
| 7,731,380 | B2 | 6/2010 | Wu |
| 7,735,255 | B1 | 6/2010 | Kincaid et al. |
| 7,736,013 | B2 | 6/2010 | Griffin |
| 7,743,547 | B2 | 6/2010 | Houde-Walter |
| 7,784,963 | B2 | 8/2010 | Galli et al. |
| 7,805,876 | B1 | 10/2010 | Danielson et al. |
| 7,819,547 | B1 | 10/2010 | Teetzel et al. |
| D628,323 | S | 11/2010 | Matthews et al. |
| 7,896,518 | B2 | 3/2011 | Holmes et al. |
| 7,913,441 | B1 | 3/2011 | Reed |
| D636,049 | S | 4/2011 | Hughes et al. |
| D636,837 | S | 4/2011 | Hughes et al. |
| 7,941,960 | B2 | 5/2011 | Matthews et al. |
| 7,954,971 | B1 | 6/2011 | Kincaid et al. |
| 8,028,461 | B2 | 10/2011 | NuDyke |
| 8,052,297 | B2 | 11/2011 | Gross et al. |
| 8,117,782 | B2 | 2/2012 | Gross et al. |
| 8,132,355 | B1 | 3/2012 | Kincaid et al. |
| 8,220,946 | B1 | 7/2012 | Teetzel |
| 8,226,267 | B2 | 7/2012 | Sharrah et al. |
| 8,256,154 | B2 | 9/2012 | Danielson et al. |
| D669,552 | S | 10/2012 | Essig et al. |
| D669,553 | S | 10/2012 | Hughes et al. |
| D669,957 | S | 10/2012 | Hughes et al. |
| D669,958 | S | 10/2012 | Essig et al. |
| D669,959 | S | 10/2012 | Johnston et al. |
| 8,276,307 | B2 | 10/2012 | Deros |
| 8,287,157 | B2 | 10/2012 | Sharrah et al. |
| D672,005 | S | 12/2012 | Hedeen et al. |
| 8,322,066 | B2 | 12/2012 | Westra |
| D673,709 | S | 1/2013 | Sharrah |
| D674,525 | S | 1/2013 | Sharrah et al. |
| D674,861 | S | 1/2013 | Johnston et al. |
| D674,862 | S | 1/2013 | Johnston et al. |
| 8,371,729 | B2 | 2/2013 | Sharrah et al. |
| 8,453,369 | B1 | 6/2013 | Kincaid et al. |
| D687,120 | S | 7/2013 | Hughes et al. |
| 8,499,484 | B2 | 8/2013 | Schneider et al. |
| 8,510,979 | B1 | 8/2013 | Mortimer |
| D689,162 | S | 9/2013 | Hilbourne et al. |
| D692,518 | S | 10/2013 | Anderson et al. |
| D693,898 | S | 11/2013 | Essig et al. |
| 8,578,647 | B2 | 11/2013 | Storch et al. |
| 8,584,392 | B1 | 11/2013 | Young |
| D694,847 | S | 12/2013 | Anderson et al. |
| D694,848 | S | 12/2013 | Anderson et al. |
| D696,376 | S | 12/2013 | Anderson et al. |
| 8,607,492 | B2 | 12/2013 | Hartley et al. |
| 8,662,701 | B2 | 3/2014 | Sharrah et al. |
| 8,683,731 | B2 | 4/2014 | Kowalczyk et al. |
| 8,683,733 | B2 | 4/2014 | Gross et al. |
| 8,701,331 | B2 | 4/2014 | Schneider et al. |
| D704,297 | S | 5/2014 | Cheng |
| 8,727,556 | B2 | 5/2014 | Swan |
| 8,727,561 | B2 | 5/2014 | Sharrah et al. |
| 8,727,565 | B2 | 5/2014 | Domagala et al. |
| D709,158 | S | 7/2014 | Wells |
| D709,585 | S | 7/2014 | Klecker et al. |
| D709,981 | S | 7/2014 | Johnston et al. |
| 8,779,583 | B2 | 7/2014 | Pressel et al. |
| 8,779,683 | B2 | 7/2014 | Snyder et al. |
| 8,783,908 | B2 | 7/2014 | Gross et al. |
| D712,001 | S | 8/2014 | Wells |
| 8,813,412 | B2 | 8/2014 | Rorick |
| 8,820,690 | B2 | 9/2014 | Weber |
| 8,857,097 | B2 | 10/2014 | Rorick |
| 8,904,698 | B2 | 12/2014 | Riley et al. |
| 8,915,009 | B2 | 12/2014 | Caulk et al. |
| 8,960,942 | B2 | 2/2015 | Galli et al. |
| 8,973,296 | B1 | 3/2015 | Kocmich, IV |
| D729,339 | S | 5/2015 | Chavez et al. |
| D732,134 | S | 6/2015 | Wells |
| 9,091,508 | B2 | 7/2015 | Prieto |
| D738,455 | S | 9/2015 | Homem de Mello Anderson et al. |
| D738,456 | S | 9/2015 | Hughes |
| D738,457 | S | 9/2015 | Johnston |
| D738,987 | S | 9/2015 | Hughes |
| 9,134,094 | B2 | 9/2015 | Hilbourne et al. |
| D740,388 | S | 10/2015 | Klecker et al. |
| D742,991 | S | 11/2015 | Klecker et al. |
| D749,689 | S | 2/2016 | Cheng et al. |
| 9,322,617 | B2 | 4/2016 | Hartley et al. |

(56) References Cited

U.S. PATENT DOCUMENTS

D755,340 S 5/2016 Essig
D755,341 S 5/2016 Hartley
9,328,994 B2 5/2016 Hovsepian
9,377,271 B2 6/2016 Kowalczyk, Jr. et al.
D763,398 S 8/2016 Anderson
D763,399 S 8/2016 Anderson
D763,400 S 8/2016 Johnston
9,404,711 B1 8/2016 Hartley et al.
9,435,522 B2 * 9/2016 Galli ..... F21V 23/003
9,488,439 B2 11/2016 Galli et al.
9,506,721 B2 11/2016 Cheng et al.
9,658,031 B1 5/2017 Hedeen et al.
D792,544 S 7/2017 Hartley
9,772,161 B1 9/2017 Cheng
9,772,163 B2 9/2017 Sharrah et al.
9,810,411 B2 11/2017 Galli et al.
9,841,258 B1 12/2017 Galli et al.
9,891,023 B2 2/2018 Compton et al.
10,001,342 B2 6/2018 Sharrah et al.
10,001,344 B1 6/2018 Alford et al.
10,048,040 B1 8/2018 Ratliff
10,107,592 B1 10/2018 Huang et al.
2002/0100202 A1 8/2002 Lin et al.
2002/0100204 A1 8/2002 Kim
2003/0101632 A1 6/2003 Davenport et al.
2003/0202345 A1 10/2003 Kim
2004/0148842 A1 8/2004 Aalto et al.
2005/0243542 A1 11/2005 Kim
2005/0246937 A1 11/2005 Kim
2006/0196099 A1 9/2006 Matthews et al.
2006/0242882 A1 11/2006 Liu
2007/0006512 A1 1/2007 Williams et al.
2007/0068058 A1 3/2007 Remo
2007/0068059 A1 3/2007 Kim
2007/0074444 A1 4/2007 Kim
2007/0113462 A1 5/2007 Ho
2007/0147042 A1 6/2007 Sharrah et al.
2007/0193103 A1 8/2007 Cheng
2007/0227056 A1 10/2007 Howe et al.
2007/0253189 A1 11/2007 Kim
2007/0277422 A1 12/2007 Ding
2008/0040965 A1 * 2/2008 Solinsky ..... F41G 1/345
42/90
2008/0094823 A1 4/2008 Kim
2008/0148619 A1 6/2008 Rogers et al.
2008/0205037 A1 8/2008 Griffin
2008/0253110 A1 10/2008 Wu
2009/0013580 A1 1/2009 Houde-Walter
2009/0183416 A1 7/2009 Danielson
2009/0190339 A1 7/2009 Galli et al.
2009/0190341 A1 7/2009 Galli et al.
2009/0293335 A1 12/2009 Danielson
2009/0293855 A1 12/2009 Danielson et al.
2009/0307956 A1 12/2009 Barret
2010/0020535 A1 1/2010 Sharrah et al.
2010/0043271 A1 2/2010 Williams et al.
2010/0097789 A1 4/2010 Sharrah et al.
2010/0176741 A1 7/2010 Sharrah et al.
2010/0229449 A1 9/2010 Matthews et al.
2010/0229450 A1 9/2010 Becker et al.
2010/0254135 A1 * 10/2010 Bayat ..... F21V 15/01
362/326
2010/0263256 A1 10/2010 Spinelli
2011/0047850 A1 3/2011 Rievley et al.
2011/0058362 A1 3/2011 Sun et al.
2011/0261559 A1 10/2011 Couture et al.
2011/0290968 A1 12/2011 Maughan et al.
2012/0055061 A1 3/2012 Hartley et al.
2012/0055062 A1 3/2012 Mironichev et al.
2012/0096755 A1 4/2012 Griffin
2012/0124885 A1 5/2012 Caulk
2012/0144718 A1 6/2012 Danielson et al.
2012/0167436 A1 7/2012 Westra
2012/0198745 A1 8/2012 Riley et al.
2012/0216440 A1 8/2012 Riley et al.
2012/0227304 A1 9/2012 Engelhardt
2013/0148367 A1 6/2013 Sharrah et al.
2013/0185982 A1 7/2013 Hilbourne et al.
2014/0018508 A1 1/2014 Masubuchi et al.
2014/0092588 A1 4/2014 Toman et al.
2014/0196349 A1 7/2014 Rogers et al.
2014/0252187 A1 9/2014 Petrovic
2014/0305021 A1 10/2014 Prieto
2015/0124436 A1 5/2015 Galli et al.
2015/0143734 A1 5/2015 Ley
2015/0159847 A1 * 6/2015 Galli ..... F41G 1/36
362/111
2015/0241169 A1 8/2015 Cheng et al.
2015/0241174 A1 8/2015 Silvennoinen
2015/0267999 A1 9/2015 Hovsepian
2015/0276347 A1 10/2015 Sharrah et al.
2015/0276352 A1 10/2015 Chang et al.
2015/0300386 A1 10/2015 Fong et al.
2016/0003460 A1 1/2016 Li et al.
2016/0025120 A1 1/2016 Swan et al.
2016/0146572 A1 5/2016 Ley
2016/0161220 A1 * 6/2016 Moore ..... F41G 1/35
42/117
2016/0195366 A1 7/2016 Kowalczyk et al.
2016/0209168 A1 * 7/2016 Sharrah ..... F41G 11/004
2016/0209174 A1 7/2016 Hartley et al.
2016/0349013 A1 12/2016 Ley
2017/0138701 A1 5/2017 Kowalczyk, Jr. et al.
2017/0167817 A1 6/2017 Hayes
2017/0219314 A1 8/2017 McMakin
2017/0248389 A1 8/2017 DiCarlo et al.
2018/0023926 A1 1/2018 Jayaprakash
2018/0031352 A1 2/2018 Zeisler et al.
2019/0154243 A1 * 5/2019 Worman ..... F21V 19/004

OTHER PUBLICATIONS

M3 Tactical Illuminator Light Rail Adapter For Dovetails, GG&G, archived Jan. 13, 2004, accessed Jun. 21, 2017, 3 pages.

* cited by examiner

ELECTRONIC FIREARM ACCESSORY WITH LIGHT SOURCE

CROSS-REFERENCE TO RELATED APPLICATIONS

This application claims priority to U.S. application Ser. No. 17/389,787, filed Jul. 30, 2021, which claims priority to U.S. application Ser. No. 15/941,971, filed Mar. 30, 2018, now U.S. Pat. No. 11,105,586, the entireties of which are hereby incorporated by reference.

FIELD

The present disclosure generally relates to firearm accessories and more particularly to firearm accessory mounts and switches.

BACKGROUND

Firearm accessories use various types of mounting systems for mounting the accessories on firearms. For example, some rifles include a handguard or other structure having one or more accessory rails thereon, and some handguns include a rail under the barrel extending forward of the trigger guard. Firearm accessories have different types of mounts configured to interface with such rails to mount the accessories on the rails.

Electronic firearm accessories such as lights and lasers usually include some type of switch to enable the user to turn the accessory on or off or to otherwise change an operation (e.g., mode) of the accessory.

SUMMARY

In one aspect, a firearm accessory for mounting on a firearm includes an accessory rail having opposite sides extending along a length of the accessory rail and having a recess between the opposite sides. The firearm accessory includes an accessory body having a firearm axis along which the length of the accessory rail extends when the firearm accessory is mounted on the firearm. The firearm accessory includes a firearm rail mount connected to the accessory body. The firearm rail mount includes a first rail engagement arm and a second rail engagement arm. The first and second rail engagement arms are spaced from each other to define a gap for receiving the rail therein. The first and second rail engagement arms are shaped and arranged to engage opposite sides of the accessory rail when the accessory rail is received in the gap for mounting the firearm accessory on the firearm. The firearm rail mount includes a retainer secured to the accessory body. The retainer has recess engagement structure sized and shaped to interface with the recess of the accessory rail to prevent forward movement of the firearm accessory along the length of the accessory rail. The retainer is movable with respect to the accessory body to change a position of the retainer with respect to the accessory body along the firearm axis.

In another aspect, an electronic firearm accessory is mountable on a firearm. The electronic firearm accessory includes an accessory body and a mount for mounting the accessory body on the firearm. A light source is supported by the accessory body. Circuitry is in electrical communication with the light source. A switch assembly is supported by the accessory body. The switch assembly includes an electronic switch in electrical communication with the circuitry. An actuator includes a push member engageable by a user and movable with respect to the electronic switch for actuating the electronic switch. The push member has an inner surface spaced from and facing the electronic switch. The actuator includes a finger having a proximal portion and a tip. The finger extends inward from the proximal portion to the tip adjacent the electronic switch. The tip is aligned with the electronic switch to press the electronic switch when the actuator is actuated.

In another aspect, an electronic firearm accessory includes a rear portion, a forward portion, and a length extending therebetween. The electronic firearm accessory includes an accessory body and a mount for mounting the accessory body on the firearm. The accessory body has a firearm axis along which the length of the firearm extends when the electronic firearm accessory is mounted on the firearm. A light source is supported by the accessory body. Circuitry supported by the accessory body is in electrical communication with the light source. A circuit board structure at least partially defines the circuitry. The electronic firearm accessory includes first and second switch assemblies. The first switch assembly includes a first electronic switch and a first actuator. The second switch assembly includes a second electronic switch and a second actuator. The first and second electronic switches are mounted on opposite sides of the circuit board structure and face laterally with respect to the firearm axis. The first and second actuators are engageable by and movable by a user to actuate the respective first and second electronic switches.

In yet another aspect, an electronic firearm accessory is mountable on a firearm. The electronic firearm accessory is usable with at least one battery. The electronic firearm accessory includes a housing defining a battery compartment sized and shaped for holding the at least one battery therein. The housing defines an opening to the battery compartment. The opening includes an outer end and an inner end. The housing includes a first housing portion and a second housing portion separate from and secured to the first housing portion. The housing has a seam between the first and second housing portions. The seam extends between the inner end of the opening and the outer end of the opening. A cap is sized and shaped to fit in the opening. A keeper inside the housing is configured to engage the cap to releasably maintain the cap in the opening. The accessory includes a mount for mounting the housing on the firearm. A light source is supported by the housing. Circuitry in electrical communication with the light source is configured to provide electrical communication between the battery compartment and the light source.

Other objects and features of the present disclosure will be in part apparent and in part pointed out herein.

BRIEF DESCRIPTION OF THE DRAWINGS

Corresponding reference characters indicate corresponding parts throughout the drawings.

DETAILED DESCRIPTION

Figure 1:
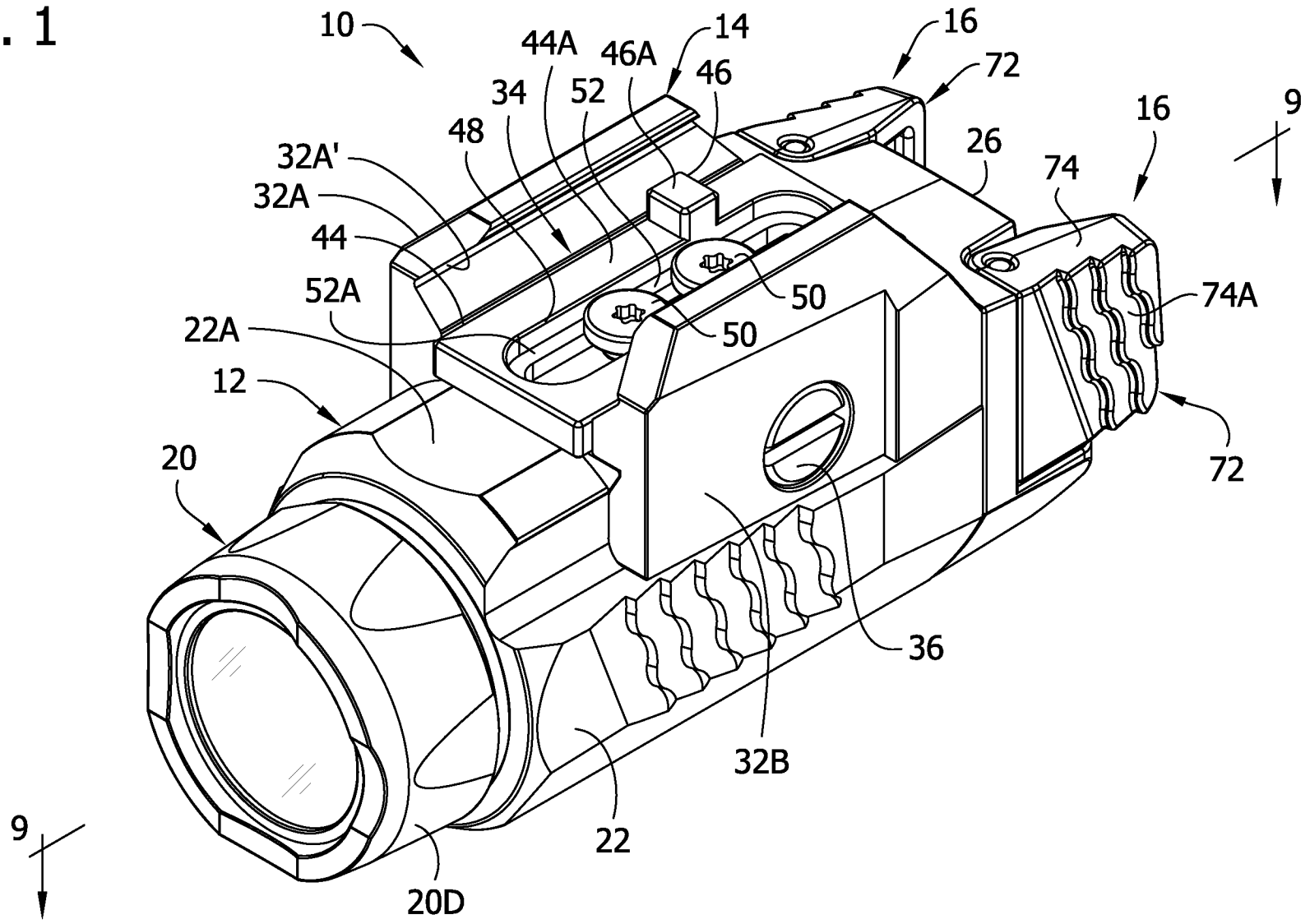
FIG. 1 is front perspective of a first embodiment of a firearm accessory of the present disclosure.
Figure 2:
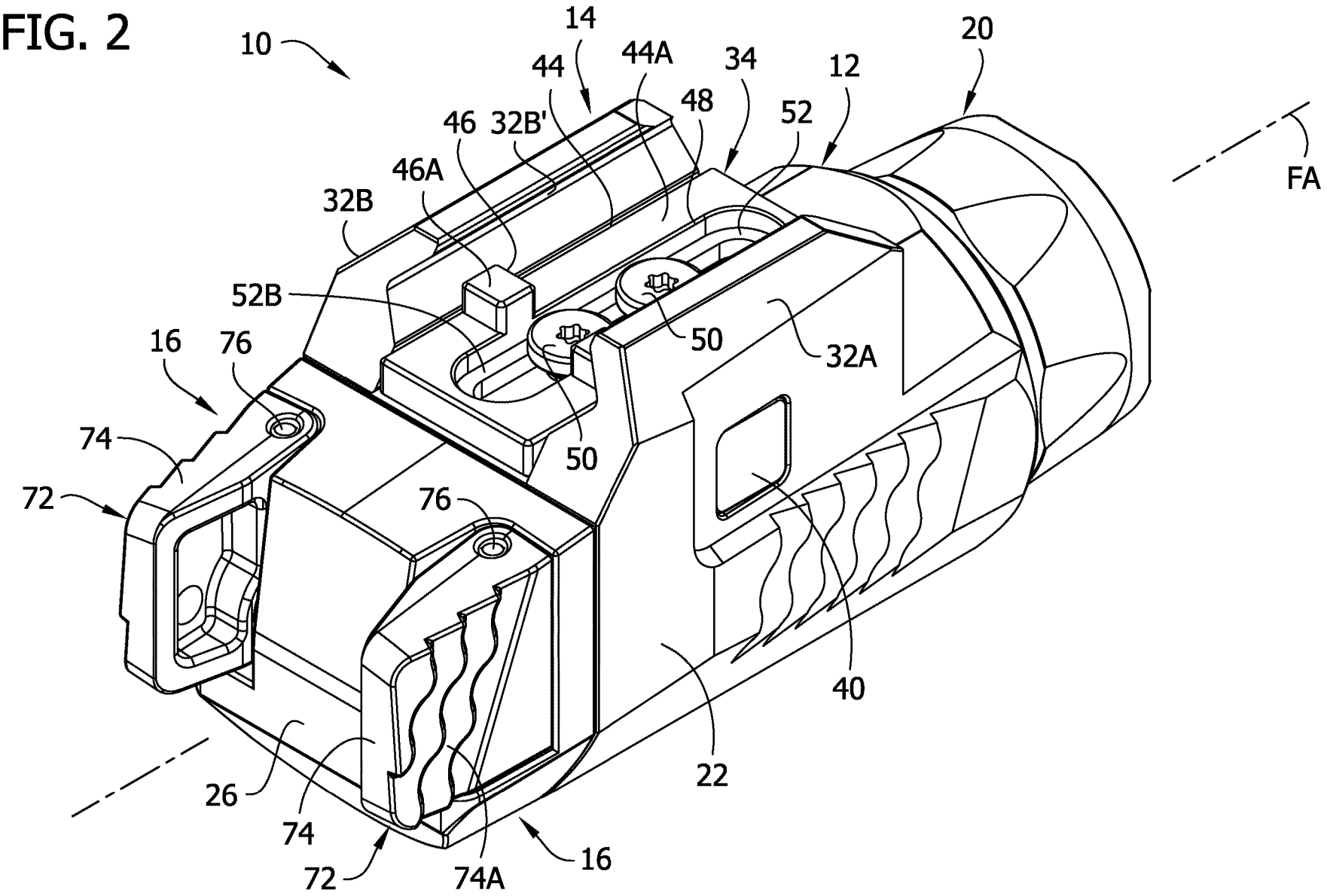
FIG. 2 is a rear perspective of the firearm accessory of FIG. 1.

Referring to FIGS. 1 and 2, a firearm accessory of the present disclosure is generally indicated by the reference number 10. In the illustrated embodiment, the firearm accessory 10 is an electronic firearm accessory in the form of a light for illuminating an area in front of the firearm (e.g., to assist in acquiring a target and/or aiming the firearm at the target). It will be understood that the firearm accessory can be a different accessory such as a laser, or a light plus laser combination, or non-electronic accessory etc. without departing from the scope of the present invention.

Figure 4:
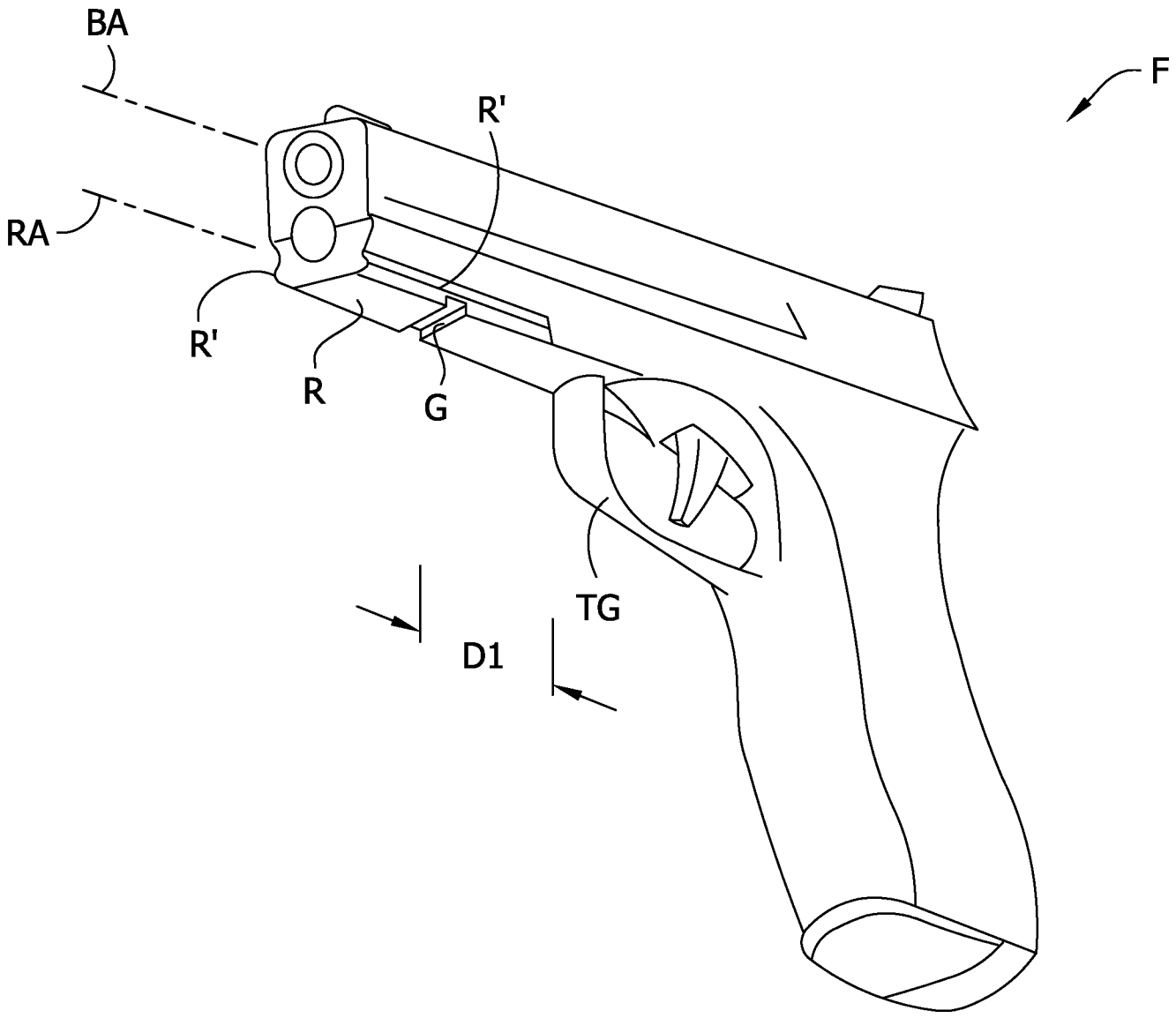
FIG. 4 is a bottom perspective of a firearm having an accessory mounting rail.

The light 10 is configured for mounting on a firearm by connecting to a rail of the firearm. Accessory mounting rails are commonly provided on long guns such as rifles and shotguns, as well as on handguns such as pistols and revolvers. The illustrated light 10 is intended for mounting on an accessory rail of a handgun in front of a trigger guard of the handgun. Although the light 10 is discussed herein as being intended for a handgun, it will be appreciated that the light can be mountable on an accessory rail of a different type of firearm without departing from the scope of the present invention. An example handgun F including an accessory mounting rail R is shown in FIG. 4. The accessory rail R extends forward of a trigger guard TG along a rail axis RA that is generally parallel to a barrel axis BA of the handgun. The illustrated accessory rail R is shown as an integral part of the handgun F, but in other embodiments the accessory rail can be separate from and mounted on the handgun. Opposite left and right sides of the rail R define ridges R' extending along the rail axis RA that are configured for retainably mounting the light 10 on the rail. A recess G (e.g., slot or groove) in the bottom of the rail R extends transverse to the rail axis RA and is used to locate and prevent movement of the accessory along the rail. The position of the recess G along the length of the rail R is not standard across all brands of handguns. In other words, a distance D1 from the recess R to the trigger guard TG is different on various handguns. Some accessory rails may have multiple recesses spaced along the length of the rail at different distances from the trigger guard. It is desirable to mount the light 10 on the handgun F close to the trigger guard TG, so that switches of the light may be conveniently actuated by a user's hand holding the handgun. As will become apparent, the light 10 is designed to be used with a wide range of handguns having rails of different constructions (e.g., different rail recess locations) and is configurable to enable adjustable mounting on the handgun rail R to customize the location of the light with respect to the trigger guard TG.

Figure 5:
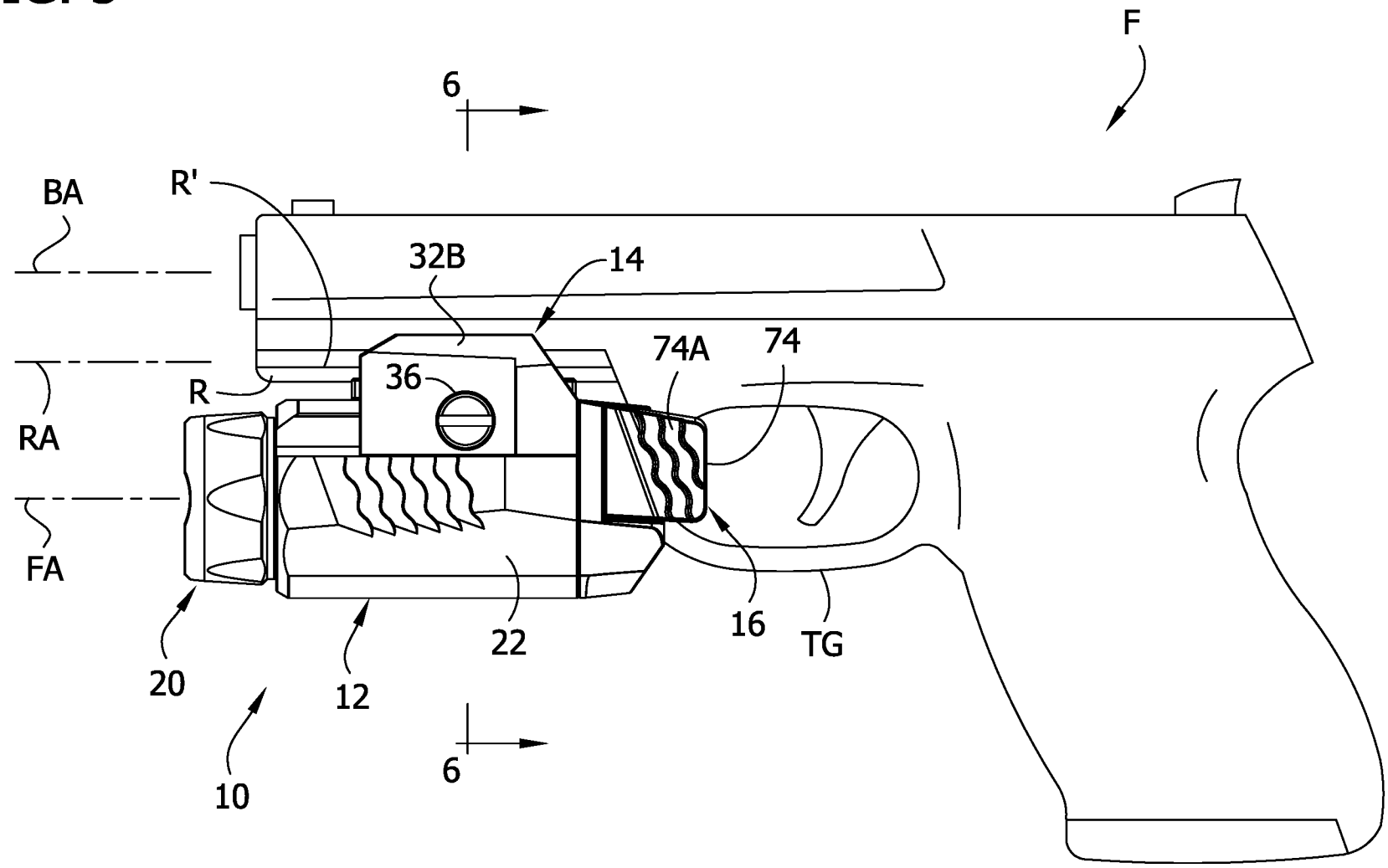
FIG. 5 is a side elevation of the firearm having the firearm accessory mounted on the accessory mounting rail.

Referring now to FIGS. 1 and 2, the light generally includes an accessory body 12, a firearm rail mount 14, and two switch assemblies 16. The accessory body 12 includes a light head 20 and houses one or more batteries 18 (FIG. 9) (broadly, "power source"), as described in further detail below. The firearm rail mount 14 is connected to the accessory body 12 and is configured to support the accessory body on the firearm rail R. The switches 16 are configured to be selectively positioned adjacent the trigger guard TG (e.g., outboard left and right sides of the trigger guard) when the light 10 is mounted on the accessory rail R, as shown in FIG. 5. For example, one of the switches 16 may be conveniently actuated by the trigger finger of the user without significantly adjusting the user's hand on the grip of the handgun. As explained in further detail below, the switches 16 can be actuated by pressing them inward to turn the light 10 on and off, and to change between various modes of the light (e.g., high, low, strobe).

Figure 9:
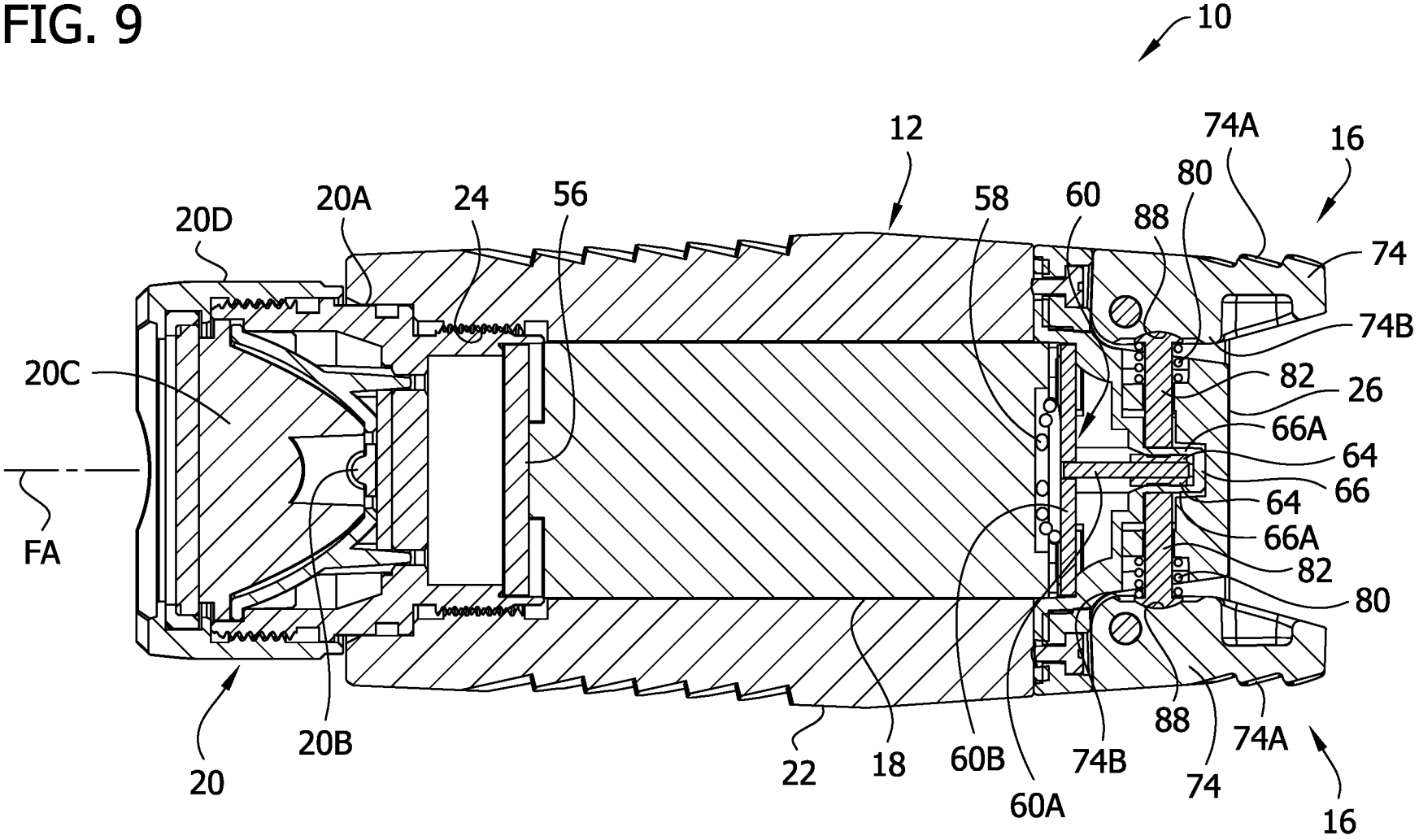
FIG. 9 is a section of the firearm accessory taken in a plane including line 9-9 of FIG. 1.

Referring to FIG. 9, the accessory body 12 includes a housing 22 defining a generally cylindrical battery compartment holding the battery 18. The housing includes a threaded forward opening 24 configured to form a threaded connection with the light head 20 to support the light head on the housing. The light head 20 defines a cap that closes the front end of the housing 22 and acts as a battery compartment cover. The light head 20 includes a light head housing 20A, a light source 20B, a lens 20C, and a bezel 20D threaded on the light head housing. In the illustrated embodiment, the light source 20B is an LED, but other light sources can be used without departing from the scope of the present invention. For example, the light source could be a laser. A tail cap 26 is provided at the rear of housing 22 and will be described in further detail below.

Figure 3:
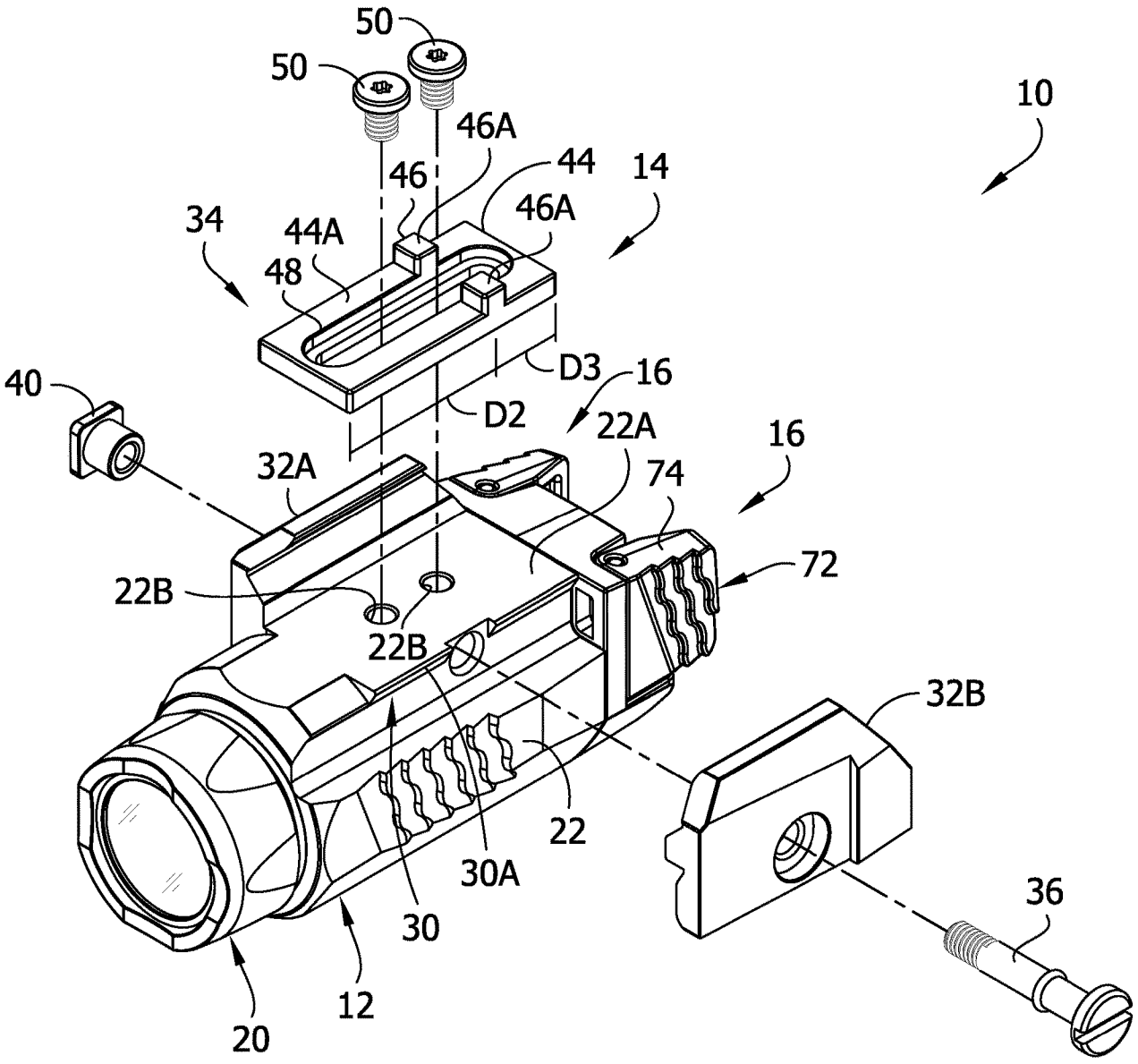
FIG. 3 is a partially exploded front perspective of the firearm accessory.

The accessory body 12 has a front end defined by the light head 20, a rear end defined by the tail cap 26, and a length extending between the front and rear ends. The accessory body 12 has a width transverse to the length that is less than the length, providing the accessory body with an elongate shape. Other shapes and constructions can be used without departing from the scope of the present invention. The accessory body 12 has a firearm axis FA along which the length of the accessory rail R extends when the light 10 is mounted on the handgun F. When the light 10 is mounted on the rail, the firearm axis FA of the accessory body 12 is generally parallel with the barrel axis BA of the firearm. Referring to FIGS. 1-3, the housing 22 includes left and right side walls extending forward from the tail cap 26 to the light head 20. As shown in FIG. 3, the right side wall defines a rail engagement arm receiver 30 including a ridge 30A extending along the firearm axis FA, for reasons which will become apparent. The housing 22 has a generally flat upper wall 22A including two threaded openings 22B, for reasons which will be explained in further detail below.

Referring to FIGS. 1-3, the firearm rail mount 14 includes first and second rail engagement arms 32A, 32B, a retainer 34, and three fasteners 36, 38. The first and second rail engagement arms 32A, 32B are spaced from each other to define a gap for receiving the rail R therein. The first and second rail engagement arms 32A, 32B are shaped and arranged to engage respective ridges R' on the opposite sides of the rail R when the rail is received in the gap for retaining the light 10 on the rail. More specifically, the arms 32A, 32B have inward facing rail engagement surfaces 32A', 32B' shaped to conformally engage the ridges R' on the opposite sides of the rails R. In the illustrated embodiment, the rail engagement surfaces 32A', 32B' are concave, and the arms are configured for clamping on the rail R. The first rail engagement arm 32A is formed as one piece with the housing 22 and extends upward from the housing. The second rail engagement arm 32B is separable from the housing 22. A lower portion of the second rail engagement arm 32B is configured to conformally engage the ridge 30A of the rail engagement arm receiver 30 to support and locate the second rail engagement arm 32B on the housing 22. The second rail engagement arm 32B is secured to the housing 22 by the fastener 36 in the form a bolt including a head and a threaded shaft. The threaded shaft extends through a transverse bore extending through an upper portion of the housing 22 to a threaded opening of a nut 40 at the other end of the bore. The nut 40 has a flange that limits movement of the nut toward the second rail engagement arm 32B. The arrangement is such that rotation of the bolt 36 tending to thread the bolt into the nut 40 causes the bolt to draw the second rail engagement arm 32B toward the first rail engagement arm 32A. To mount the light 10 on a handgun F, the rail engagement arms 32A, 32B are spaced appropriately to permit the rail R to be inserted between the rail engagement arms, and then the bolt 36 is rotated to clamp the rail between the rail engagement arms. The fit of the rail engagement surfaces 32A', 32B' against the ridges R' of the rail R locates the light 10 vertically on the handgun F, and clamping of the arms 32A, 32B on the rail may provide resistance against longitudinal movement of the light along the rail. Arms that do not clamp the rail yet releasably retain the accessory on the rail can be used without departing from the scope of the present invention.

The retainer 34 is configured to engage the recess G of the rail R to limit movement of the light 10 along the length of the rail. For example, when the handgun F is fired, recoil of the handgun may tend to move the rail R rearward with respect to the light 10. The retainer 34 assists in preventing the light from migrating forward on the rail R in response to recoil of the handgun F. The retainer 34 generally includes a base 44 and recess engagement structure 46 sized and shaped to interface with the recess G. The base 44 engages the accessory body 12, and the recess engagement structure 46 protrudes upward for receipt in the rail recess G. The retainer 34 has a forward end, a rearward end, and a length extending therebetween along the firearm axis FA. As explained below, the recess engagement structure 46 is offset between the front and rear ends of the retainer 34. In other words, as shown in FIG. 3, the recess engagement structure 46 is located a first distance D2 from the front end of the retainer 34 and a second distance D3 from the rear end different than the first distance.

Figure 6:
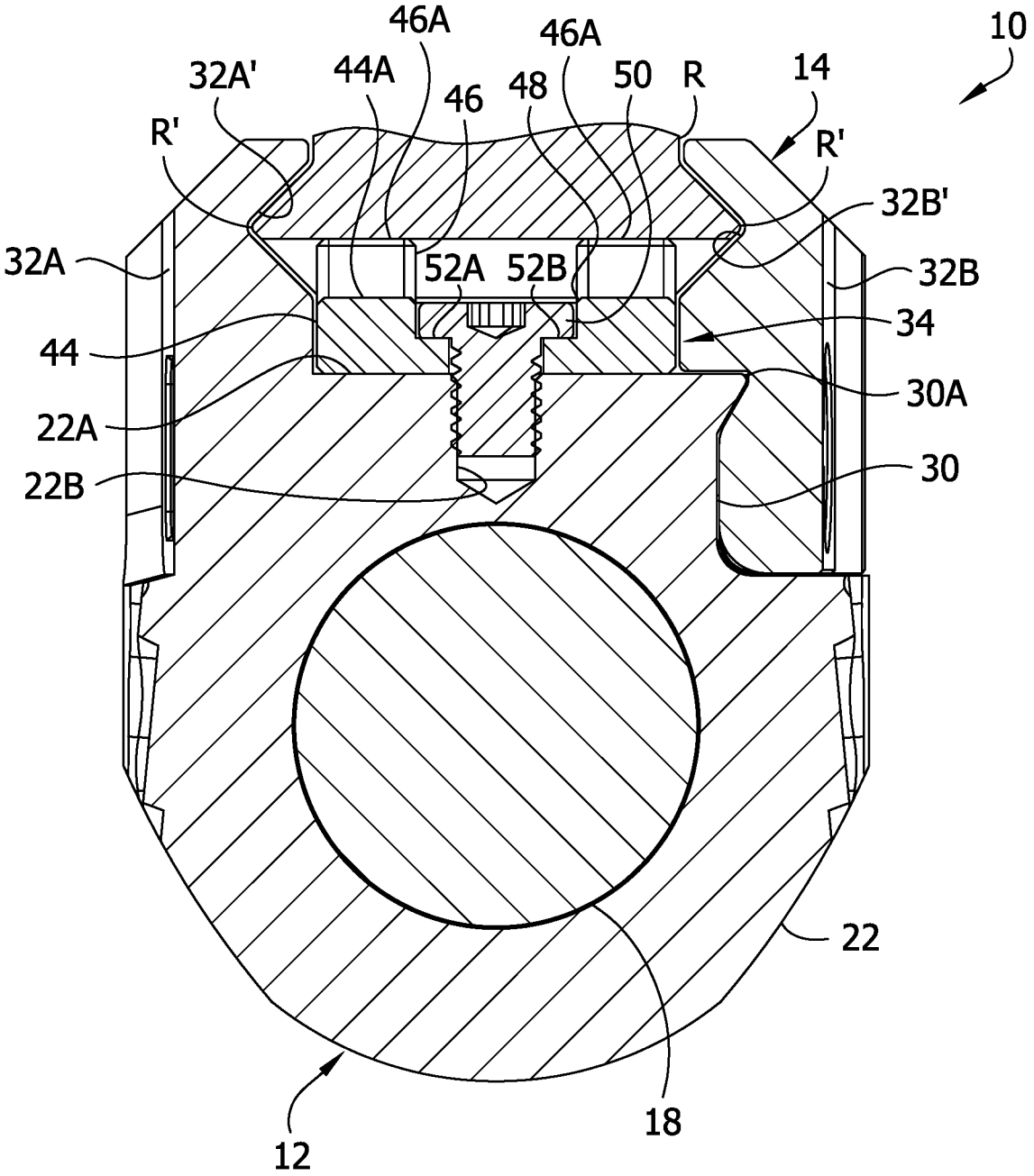
FIG. 6 is a fragmentary section of the firearm accessory on the accessory mounting rail taken in a plane including line 6-6 indicated in FIG. 5.

In the illustrated embodiment, the base 44 comprises a generally rectangular plate having a bottom surface ("accessory body engagement surface") that engages the upper wall 22A of the accessory body and having an upper surface 44A facing away from the upper wall of the accessory body. An elongate slot 48 is provided in the base 44. The elongate slot 48 has first and second ends spaced from each other along the firearm axis FA. Fasteners in the form of two screws 50 are received through the slot 48 into the threaded openings 22B in the housing 22. The screws 50 are spaced from each other along the firearm axis FA. The screws 50 include threaded shafts and heads having tool engagement sockets to assist in rotating the screws. The screws 50 are threadable into the threaded openings 22B in the housing into fastened positions (e.g., FIGS. 1, 2, 6) in which the screws maintain the retainer 34 in position with respect to the accessory body 12. More specifically, the heads of the screws 50 press the retainer 34 against the upper wall 22A of the housing 22 with sufficient force to prevent longitudinal movement of the retainer along the firearm axis FA of the accessory 10. The elongate slot 48 is configured such that the heads of the screws 50 are countersunk in the base 44 when the screws are in the fastened positions. More specifically, the elongate slot 48 includes an upper or outer section that is wider and longer than a lower or inner section of the elongate slot, defining a shoulder 52 extending around the elongate slot where the upper section meets the lower section. The shoulder 52 defines upward facing elongate fastener engagement surfaces 52A, 52B extending along opposite longitudinal sides of the elongate slot 48 against which the heads of the screws 50 bear to press the retainer against the housing. Desirably, when the screws 50 are in the fastened position, the screw heads are entirely within the upper section of the elongate slot 48 such that the screws heads are countersunk in the base 44, flush with or below the upper surface 44A of the base. The base can have other configurations without departing from the scope of the present invention. For example, in other embodiments, the bottom surface of the base may have bumps, ridges, or be otherwise configured to increase friction with the upper surface of the housing.

The recess engagement structure 46 of the retainer 34 includes first and second teeth 46A (broadly, "protrusions") extending upward from the base 44. The teeth 46A are sized and shaped to be received in the firearm rail recess G and are located on opposite sides of the elongate slot 48. The teeth 46A are provided in the form of generally rectangular posts. The teeth 46A extend upward sufficiently to be received in the firearm rail recess G when the rail engagement arms 32A, 32B are in engagement with the firearm rail R. Other types of recess engagement structure can be used without departing from the scope of the present invention.

The retainer 34 is configurable with respect to the accessory body 12 to change a location of the teeth 46A along the firearm axis FA to achieve a desired location of the light 10 with respect to the trigger guard TG. The retainer 34 is releasably fixable in various positions on the accessory body 12 along the firearm axis FA. The screws 50 can be moved to unfastened positions by rotating the screws out of the threaded openings 22B such that the screws no longer urge the retainer 34 against the accessory body 12. The screws 50 can be completely removed but need not be removed to permit movement of the retainer 34. When the screws 50 are unfastened, the base 44 of the retainer 34 can slide on the upper wall 22A of the housing 22 forward or rearward along the firearm axis FA to move the teeth 46A to a desired position. The elongate slot 48 permits the retainer 34 to move along the firearm axis FA in a relatively large range of motion without being restricted by engagement with the screws 50. Because the teeth 46A are offset on the base 44, the teeth can be moved in yet a further range of movement by removing the screws 50, reversing the orientation of the retainer 34 on the accessory body (reversing the front and rear ends of the retainer), and reinstalling the screws. When the desired location of the teeth 46A is achieved, the screws 50 are rotated to their fastened positions to secure the retainer 34 in position. The location of the teeth 46A can be finely tuned to infinite locations to provide a custom fit of the light 10 on the firearm F. In most instances, the custom fit will be chosen such that the switches 16 of the light 10 are located for convenient actuation by the user (e.g., close to the trigger guard), as shown in FIG. 5.

Figure 19:
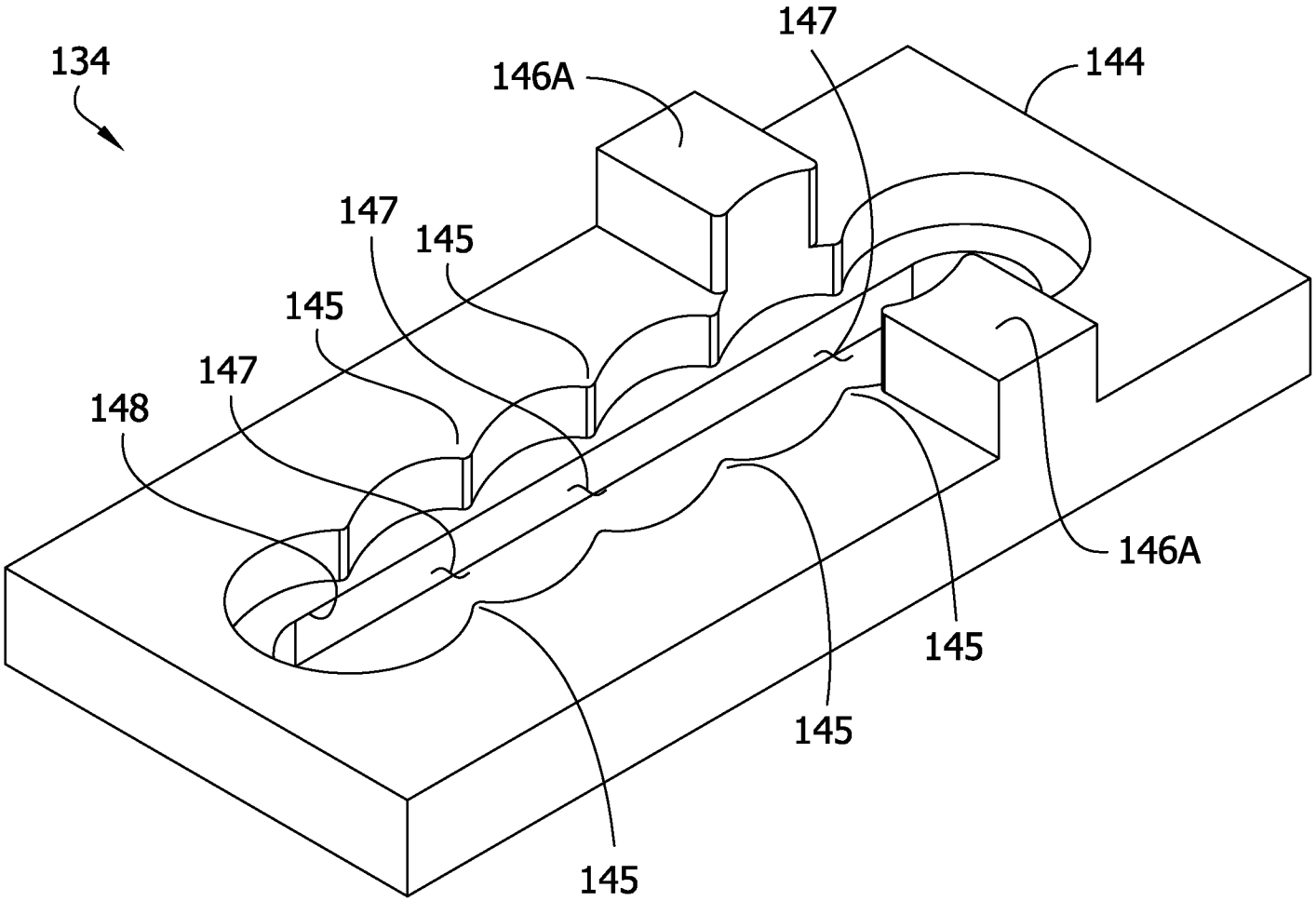
FIG. 19 is a perspective of a second embodiment of a retainer for use with the firearm accessory of FIG. 1.
Figure 20:
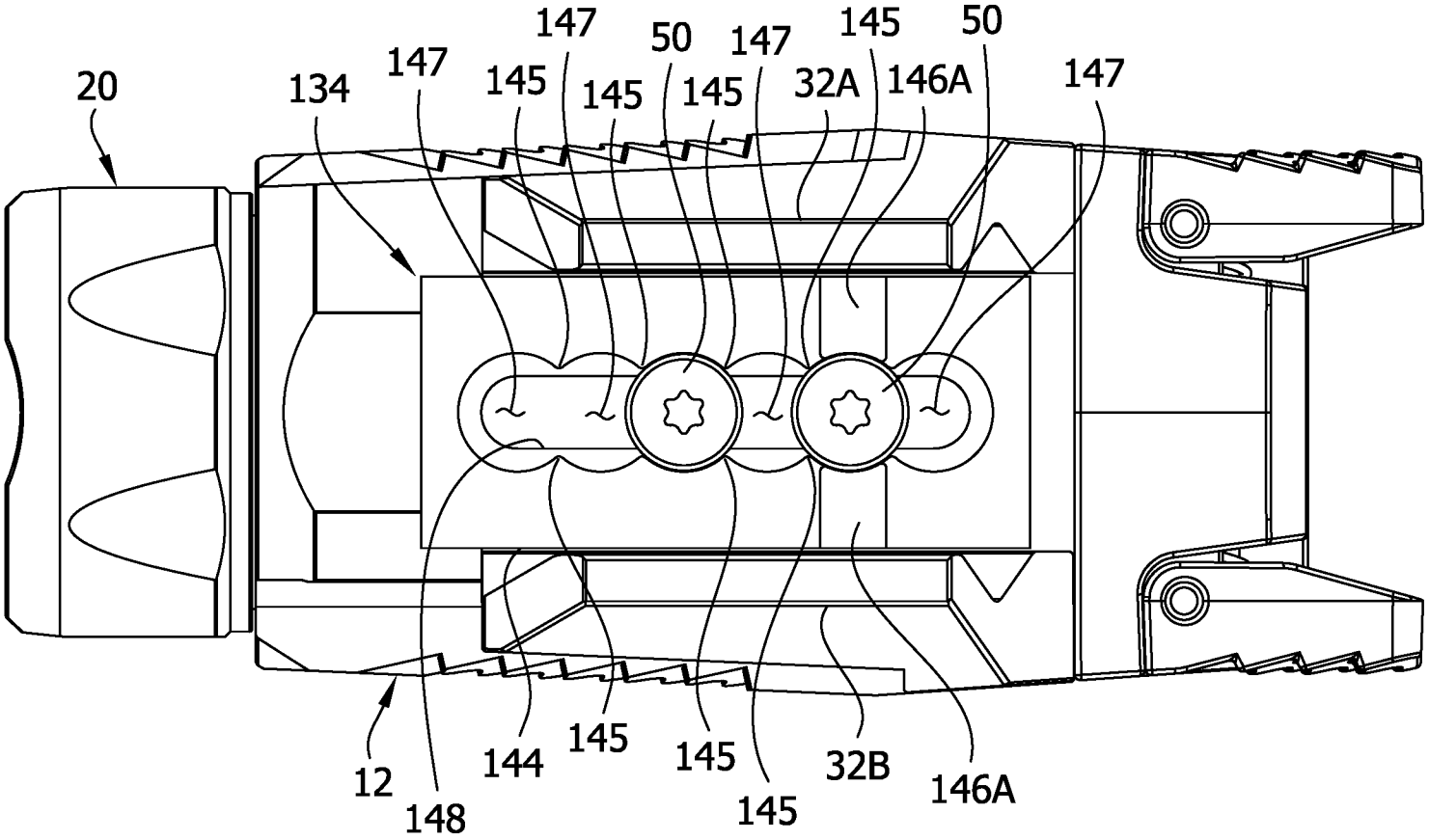
FIG. 20 is a top view of the retainer of FIG. 19 on the firearm accessory of FIG. 1.

Referring to FIGS. 19 and 20, a second embodiment of a retainer is indicated generally by the reference number 134. The retainer 134 is very similar to the retainer 34 and can be used in essentially the same way as described above with respect to the retainer 34. For example, the retainer 134 includes a base 144 comprising a generally rectangular plate and includes retainer engagement structure in the form of two teeth 146A. The two screws 50 are used to fasten the retainer 134 to the accessory body 12. An elongate slot 148 is provided in the base 144. The screws 50 extend through the slot 148 and are threadable into the threaded openings 22B (FIG. 3) to fastened positions in which the screws maintain the retainer 134 in position with respect to the accessory body 12. In this embodiment, the retainer 134 includes blocking structure 145 constructed to assist in maintaining the retainer in the desired position on the accessory body 12. In particular, the blocking structure 145 is provided to prevent the retainer 134 from moving rearward (away from the light head 20) on the accessory body 12. As explained above, when the handgun F is fired, recoil of the handgun may tend to move the rail R rearward with respect to the light 10. With the teeth 146A in the recess G of the Firearm F, the retainer 134 will move rearward conjointly with the firearm under the recoil force. Without the blocking structure 145, the sudden recoil force could cause the retainer to "slip" rearward on the accessory body. The blocking structure 145 causes the accessory body 12 to move rearward conjointly with the retainer 134 and firearm F under the recoil force. In other words, the blocking structure 145 prevents the retainer 134 from migrating rearward on the accessory body 12 in response to the recoil force. Such migration of the retainer 134 on the accessory body 12 would be shown by forward migration of the accessory body 12 with respect to the firearm F.

In the illustrated embodiment, the blocking structure comprises a series of ribs 145 protruding into the slot 148 constructed to engage the heads of the screws 50. Ribs 145 are provided at spaced locations along the length of the slot 148, and corresponding pairs of ribs are provided on opposite sides of the slot. The ribs 145 define a plurality of screw head receiving spaces 147 between adjacent pairs of ribs spaced along the length of the slot. In the illustrated embodiment, there are six screw head receiving spaces 147. The screw head receiving spaces 147 provide predetermined locations for the screws 50 to engage the retainer 134. When the firearm F is fired, the pairs of ribs 145 immediately forward of the screws 50 block forward migration of the screws in the slot 148 and thus prevent the retainer 134 from moving rearward on the accessory body 12.

It will be appreciated that other blocking structure can be used without departing from the scope of the present invention. Moreover, it will be appreciated that blocking structure on the retainer can be constructed to engage the accessory body instead of or in addition to engaging the fasteners to prevent longitudinal movement of the retainer. In one example, the accessory body could include a plurality of ribs extending widthwise across the upper wall of the accessory body, and the bottom of the retainer could include a corresponding plurality of widthwise ribs that are arranged to mesh with the accessory body ribs when the screws are fastened to prevent longitudinal movement of the retainer on the accessory body. Many other arrangements are possible.

An electrical system of the light will now be described with reference to FIGS. 7-11. The electrical system includes circuitry placing the light source 20B in electrical communication with the battery 18. The circuitry includes a first electrical contact 56 located in the battery compartment for contacting a positive terminal of the battery 18, and a second electrical contact 58 in the form of a spring located in the battery compartment for contacting a negative terminal of the battery, thus placing the battery in electrical communication with the circuitry. The circuitry includes a circuit board structure 60 in the tail cap 26 placing switch assemblies 16 in electronic communication with the circuitry. The circuitry can complete the circuit between the circuit board structure 60 and the light source 20B in any suitable way, such as an electrical lead (not shown) extending forward along the battery compartment from the circuit board structure to the light head 20. Alternatively, the housing 22 itself can be used complete the circuit from the circuit board structure 60 to the light head.

Figure 8:
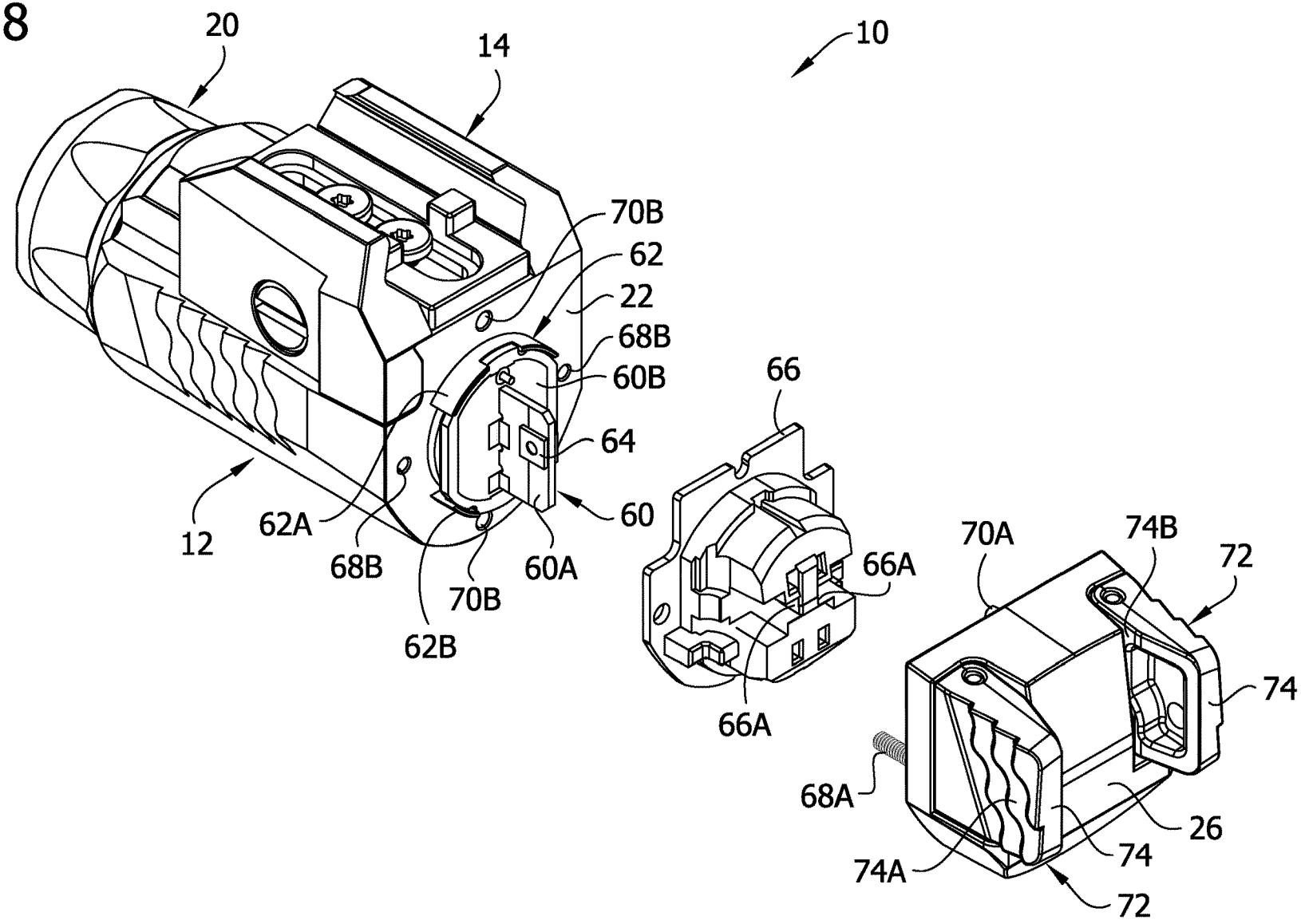
FIG. 8 is a rear perspective similar to FIG. 7 but with different parts exploded.
Figure 10:
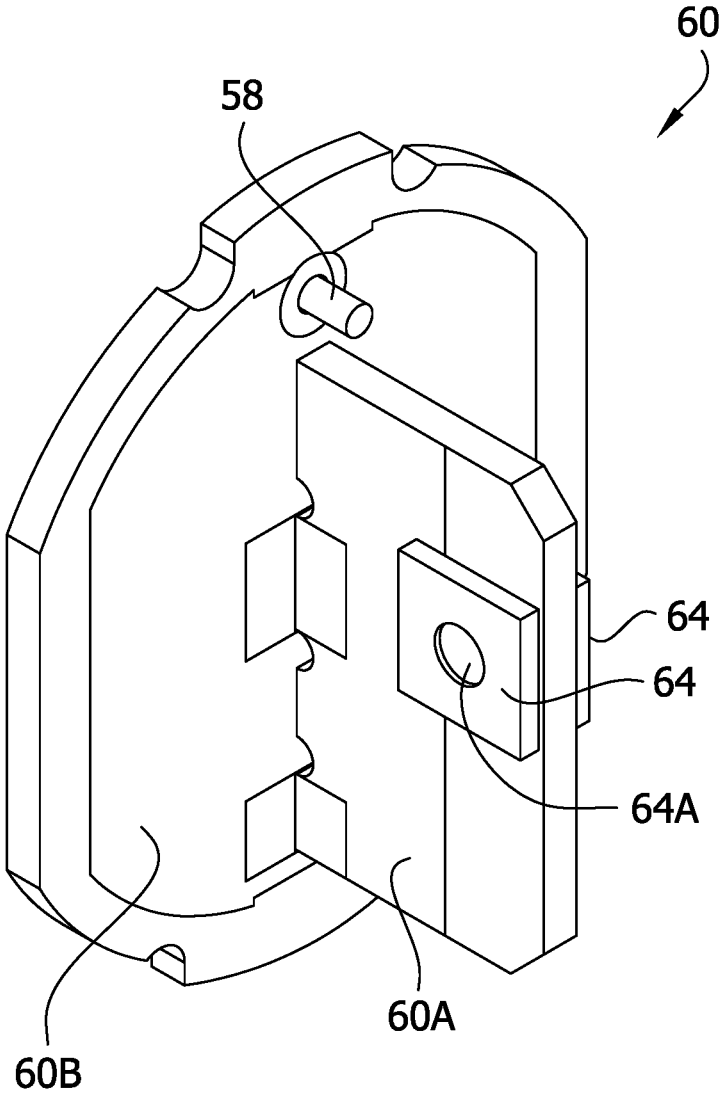
FIG. 10 is a rear perspective of an electrical assembly of the firearm accessory.
Figure 11:
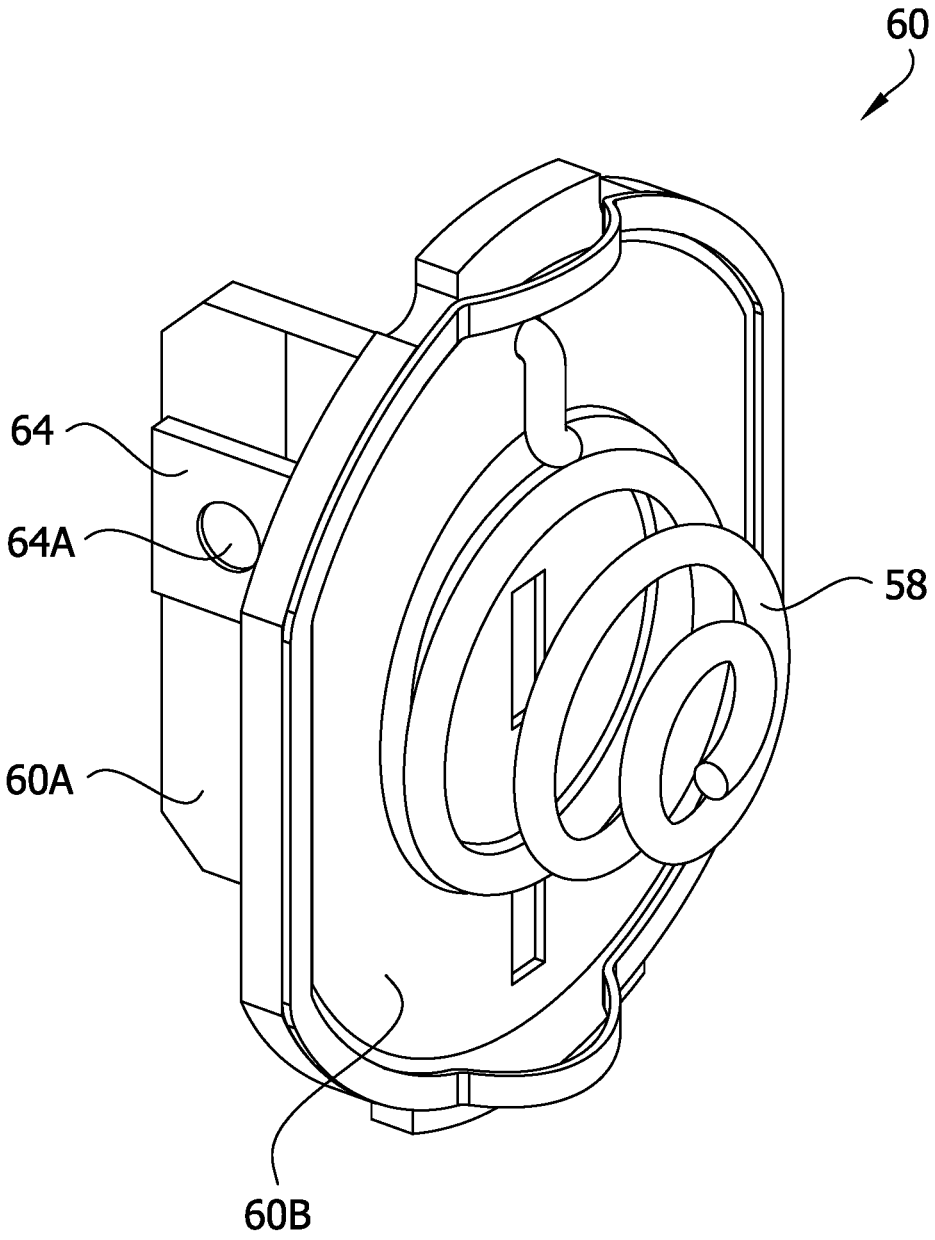
FIG. 11 is a front perspective of the electrical assembly of the firearm accessory.

As shown in FIGS. 8 and 10, the circuit board structure 60 includes a first longitudinal circuit board 60A and a second transverse circuit board 60B in electrical communication with each other. The longitudinal circuit board 60A is joined to the transverse circuit board 60B by tongue and groove connection as well as by brackets. The longitudinal circuit board 60A extends generally parallel with the firearm axis FA, and the transverse circuit board 60B extends generally perpendicular to the firearm axis. The transverse circuit board 60B is sized and shaped to have a press fit in a receptacle 62 on the rear end of the housing 22. The receptacle 62 includes an upper arcuate flange 62A and a lower arcuate flange 62B for holding the transverse circuit board 60B. As shown in FIG. 11, the spring 58 is mounted on and in electrical communication with the transverse circuit board 60B. The longitudinal circuit board 60A is centrally located between the sides of the accessory body 12 and extends along the firearm axis FA. Two electronic switches 64 are provided on opposite sides of the longitudinal circuit board 60A and are in electrical communication with the longitudinal circuit board and thus the circuitry. The electronic switches 64 face laterally with respect to the firearm axis FA. The electronic switches 64 include pressure surfaces 64A responsive to pressing thereon for actuation of the electronic switches. As shown in FIG. 8, a gasket 66 is sized and shaped to conformally fit over the rear end of the housing 22, receptacle 62, and circuit board structure 60 to isolate the circuitry from ingress of water. A section of the gasket 66 wraps around the rear end of the longitudinal circuit board 60A and includes portions 66A on opposite sides of the longitudinal circuit board overlying the pressure surfaces 64A of the electronic switches 64. The tail cap 26 is secured to the rear end of the housing 22 by left and right fasteners 68A (only one being shown) in threaded openings 68B and upper and lower studs 70A (only one being shown) in openings 70B.

Figure 7:
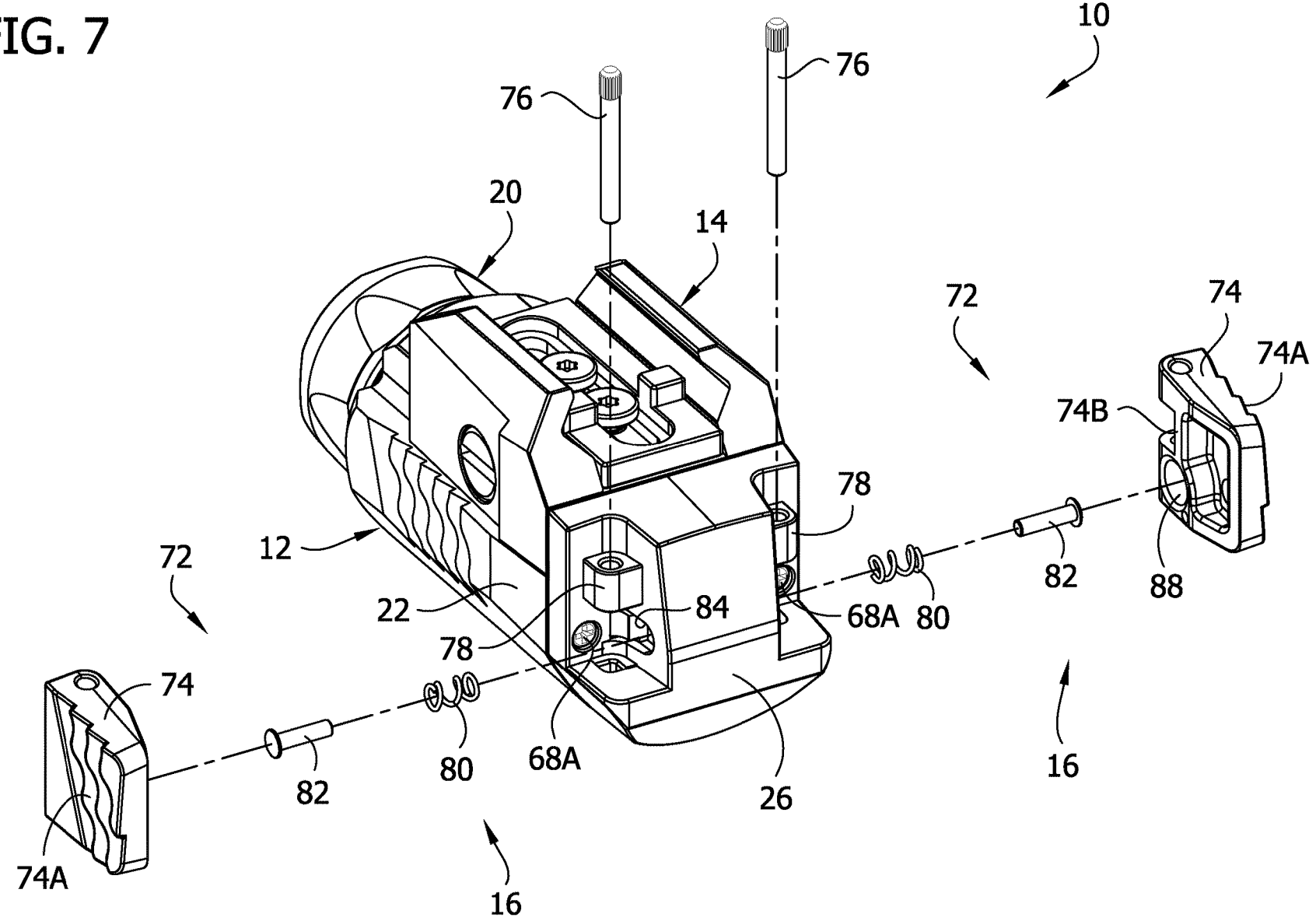
FIG. 7 is a partially exploded rear perspective of the firearm accessory.

The tail cap 26 supports switch actuators 72 configured to actuate the respective electronic switches 64. The actuators 72 are engagable by a user and movable with respect to the respective electronic switches 64 for actuating the electronic switches. As shown in FIGS. 7 and 9, the actuators 72 include paddles 74 (broadly, "push members") having proximal ends pivotally connected to the tail cap 26 by rods 76. The rods extend through brackets 78 on the tail cap 26 and through portions of the paddles 74 above and below the brackets. The paddles 74 include push surfaces 74A engageable by a hand of the user (e.g., trigger finger). In the illustrated embodiment, the push surfaces 74A have a protruding wave pattern to provide the user with tactile indication that their finger is on the push surface. The paddles 74 have inner surfaces 74B opposite the push surfaces 74A facing inward toward the firearm axis FA. The paddles 74 are pivotable inward about the rods 76 toward the firearm axis FA responsive to pushing force on the push surfaces 74A. Each actuator 72 includes a compression spring 80 and a pin 82 (broadly "finger"). The pins 82 each include a head (broadly, "proximal portion") and an elongate shaft having a tip. The pins 82 extend through the springs 80, and the pin and spring assemblies are received in recesses 84 (FIG. 7) in opposite sides of the tail cap 26. The portions 66A of the gasket 66 covering the electronic switches 64 are exposed in the recesses 84 for being pressed by the tips of the pins 82 and thus pressing the electronic switches. Each pin 82 has a longitudinal axis that extends between the pin head and tip. The pins 82 are elongate and have lengths along the longitudinal axes greater than their widths transverse to the longitudinal axes. The longitudinal axis of each pin 82 is generally perpendicular to the push surface 74A of the corresponding paddle 74 and intersects the pressure surface 64A of the respective electronic switch 64. The inner surfaces 74B of the paddles 74 each include a face 88 (FIG. 7) (broadly, "pin engagement portion") positioned to press on the heads of the respective pins 82. The faces 88 are concave and conformally engage the convex heads of the pins 82 while permitting some relative movement of the heads of the pins with respect to the paddles 74. The springs 80 have inner ends that engage the tail cap 26 and outer ends that engage the heads of the pins 82 to bias the pins away from the electronic switches 64 and thus bias the paddles 74 away from the electronic switches. The arrangement is such that the pins 82 act as fingers extending inward from the inner surfaces 74B of the paddles 74. When a paddle is pivoted inward its respective pin 82 moves linearly to compress the spring 80 and press the gasket portion 66A against the pressure surface 64A of the electronic switch 64, thus actuating the electronic switch. Accordingly, the paddle push surface 74A is pushable in the same direction in which the tip of the pin 82 moves (in the direction of the longitudinal axis of the pin) to actuate the electronic switch 64. When the user releases the paddle 74, the spring 80 pushes the pin 82 and paddle 74 outward to their non-actuated positions. Actuation of the switch 16 can turn the light 10 on, off, or otherwise change operation of the light (e.g., change between various modes of the light, such as high, low, strobe).

Switch assemblies having other configurations can be used without departing from the scope of the present invention. For example, although the pins 82 are illustrated as being separate from the paddles 74, the pins could be formed as one piece with the paddles. Moreover, other types of actuators and fingers having other configurations can be used. In some embodiments, the fingers can be omitted.

Referring to FIGS. 12-18, a second embodiment of an electronic firearm accessory of the present disclosure is indicated generally at 110. Like the accessory 10 described above, this firearm accessory is a light 110 for mounting on a firearm F. The light 110 is intended for mounting on a handgun F for illuminating an area in front of the handgun. It will be understood that the firearm accessory can be a different accessory such as a laser, or light plus laser combination, or non-electronic accessory, etc. without departing from the scope of the present invention.

Figure 12:
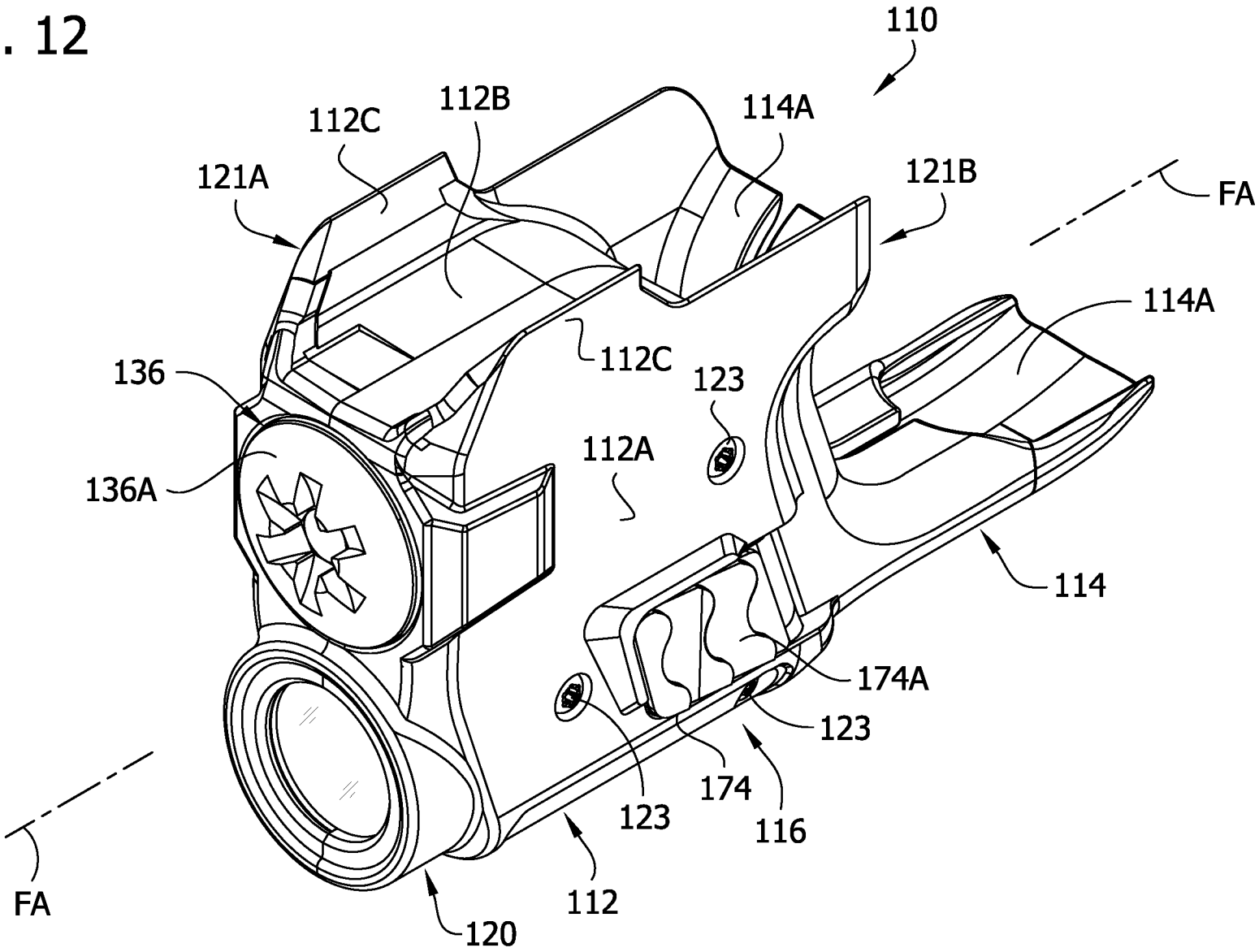
FIG. 12 is a front perspective of a firearm accessory of a second embodiment of the present disclosure.
Figure 13:
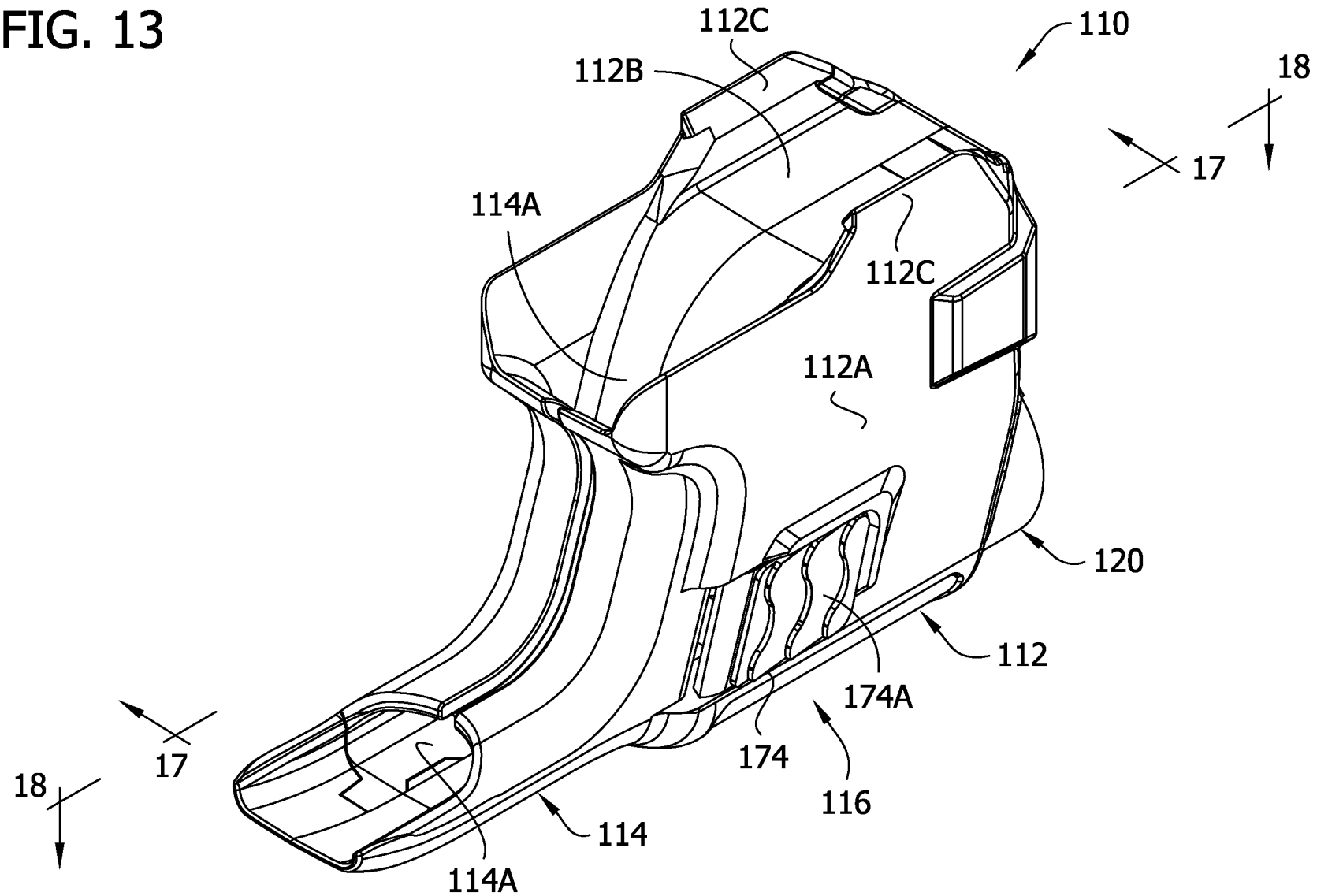
FIG. 13 is a rear perspective of the firearm accessory of FIG. 12.
Figure 14:
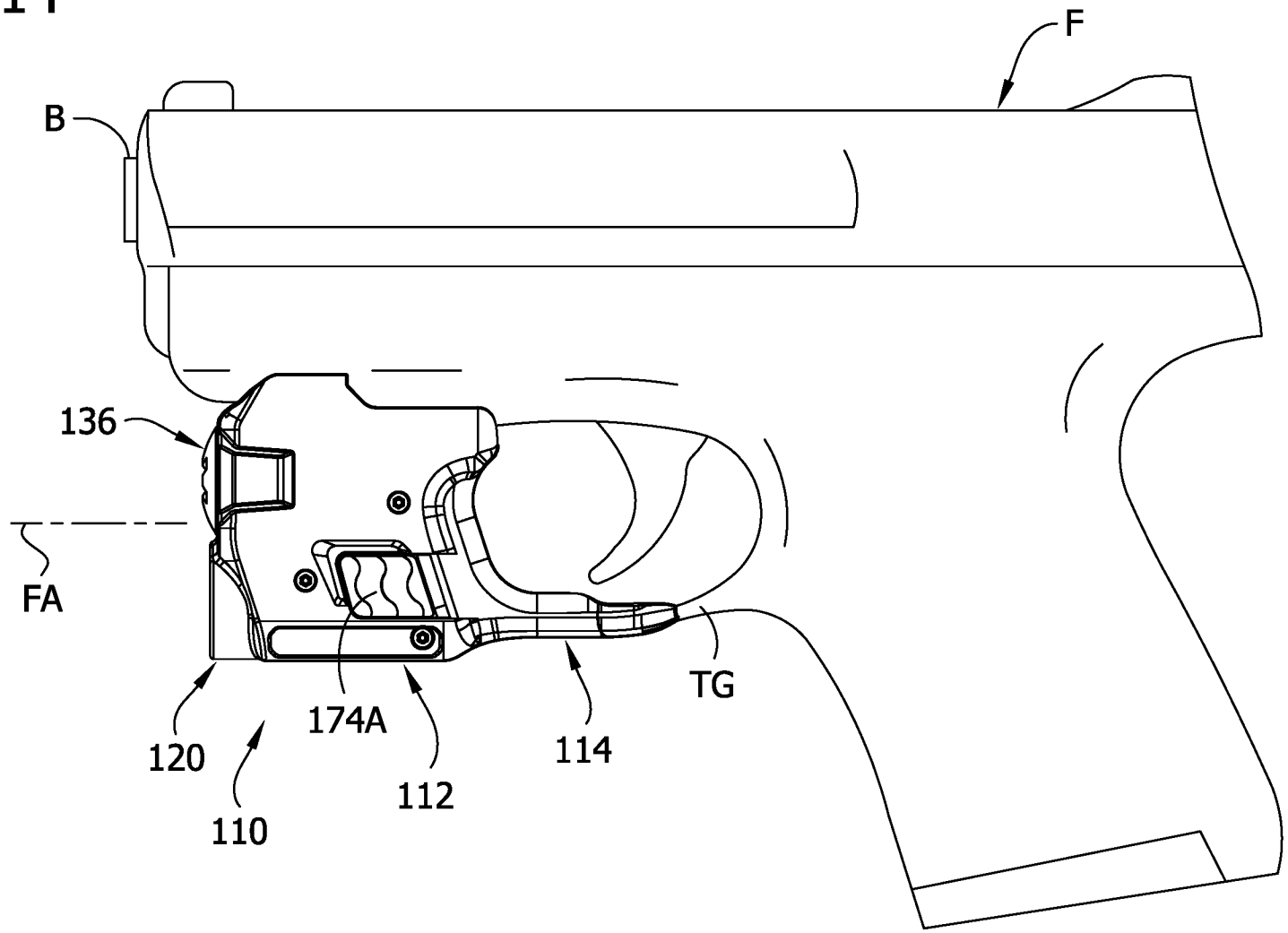
FIG. 14 is a side elevation of the firearm accessory mounted on a firearm.

Referring now to FIGS. 12 and 13, the light 110 generally includes an accessory body 112, a firearm mount 114, and two switch assemblies 116. The accessory body 112 houses one or more batteries 118 (broadly, "power source") and includes a light head 120, as described in further detail below. In this embodiment, the firearm mount 114 is configured to support the accessory body 112 on the trigger guard TG of the firearm F. The switches 116 are configured to be positioned adjacent the trigger guard TG when the light 110 is mounted on the trigger guard, as shown in FIG. 14. For example, one of the switches 116 may be conveniently actuated by the trigger finger of the user without significantly adjusting the user's hand on the grip of the handgun F. As explained in further detail below, the switches 116 can be actuated by pressing them inward to turn the light on and off, and to change between various modes of the light (e.g., high, low, strobe).

The accessory body 112 has a generally rectangular shape and includes a front end at which the light head 120 is positioned and a rear end connected to the firearm mount 114. The accessory body 112 has a length extending between the front and rear ends and a width less than and extending transverse to the length. Other shapes and constructions can be used without departing from the scope of the present invention. The accessory body 112 has a firearm axis FA along which the length of the firearm barrel B extends when the light is mounted on the handgun. When the accessory 110 is mounted on the handgun F, the firearm axis FA of the accessory body extends along the length of the firearm. Referring to FIGS. 12 and 13, the accessory body 112 includes left and right side walls 112A extending forward from the rear end to the front end. The accessory body 112 has a generally flat upper wall 112B and two fins 112C extending upward to left and right sides of the upper wall to provide an integrated appearance of the light with the firearm F. As will become apparent, the accessory body 112 defines a housing for housing internal components of the light 110.

Figure 15:
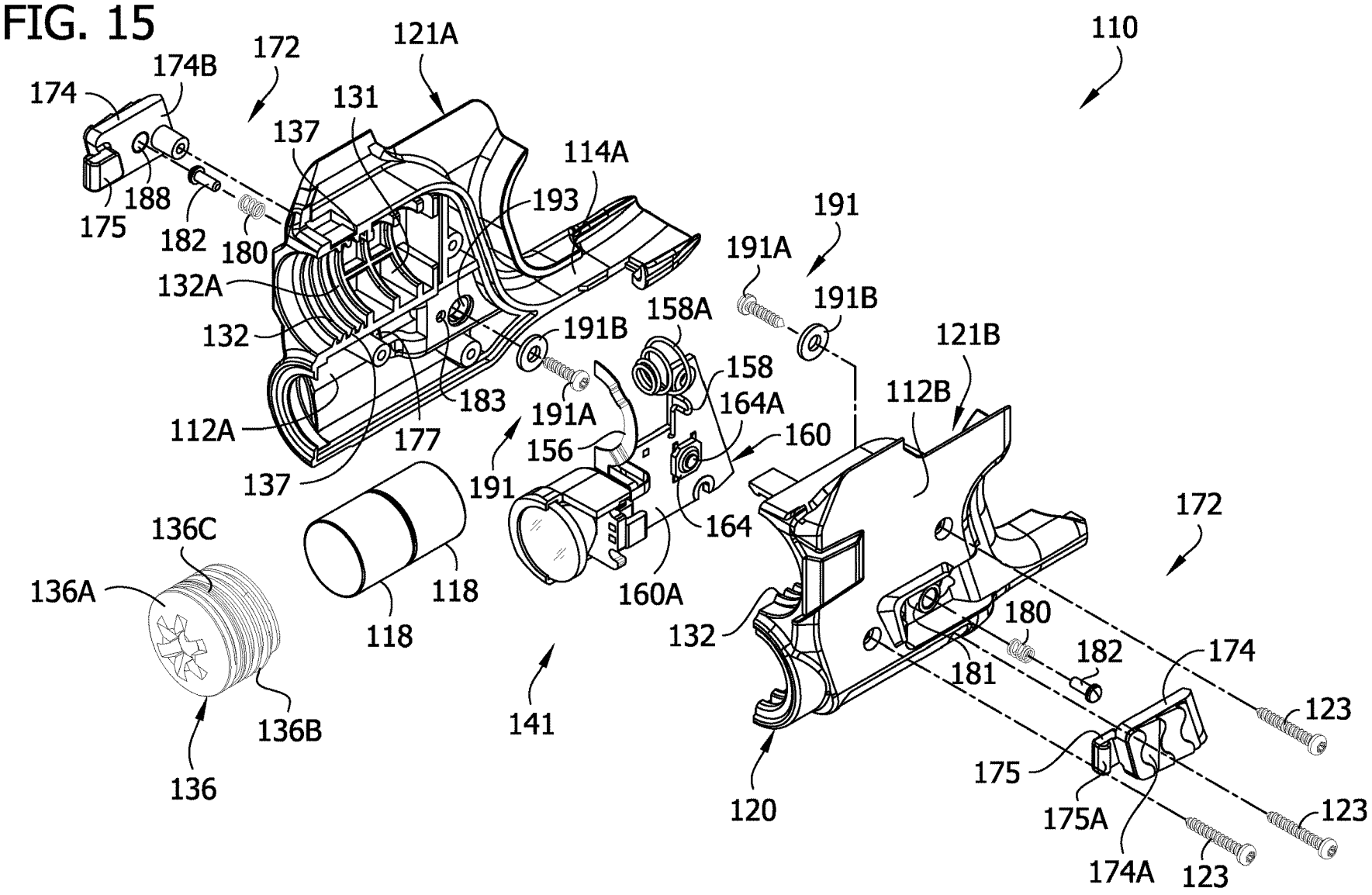
FIG. 15 is a partially exploded front elevation of the firearm accessory.

As shown in FIG. 15, the accessory body 112 and firearm mount 114 are formed by left and right shell pieces 121A, 121B constructed to fit together. For example, the shell pieces 121A, 121B may be formed of injection molded plastic. The shell pieces 121A, 121B are secured together by three screws 123 (broadly, "fasteners"). The shell pieces 121A, 121B define generally hollow interior sections in which components of the light 110 are housed. The light 110 includes a seam at which the two shell pieces 121A, 121B meet each other. In the illustrated embodiment, the seam is essentially planar, except for at a few locations. Other configurations can be used without departing from the present invention.

The firearm mount 114 is configured to envelope a forward portion of the trigger guard TG. The firearm mount 114 is generally hollow and defines a channel 114A through which the trigger guard TG extends when in the mount 114. To mount the light 110 on the firearm F, the three screws 123 are removed, the two shell pieces 121A, 121B are separated, the two shell pieces are arranged to locate the trigger guard TG in the channel 114A, and the screws 123 are reinstalled to secure the shell pieces 121A, 121B to each other and capture the trigger guard.

Figure 16:
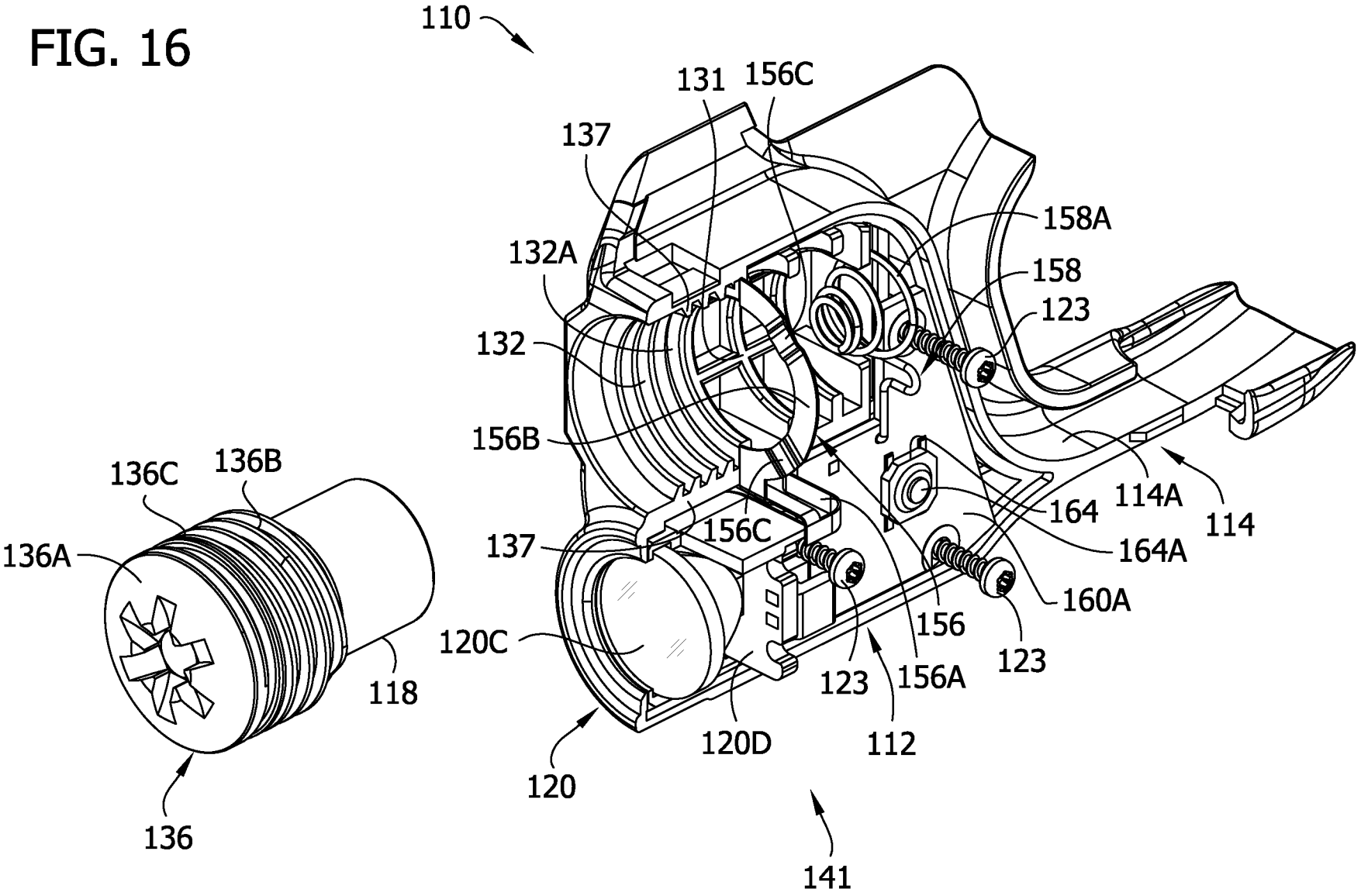
FIG. 16 is a partially exploded front perspective of the firearm accessory with certain parts removed.
Figure 17:
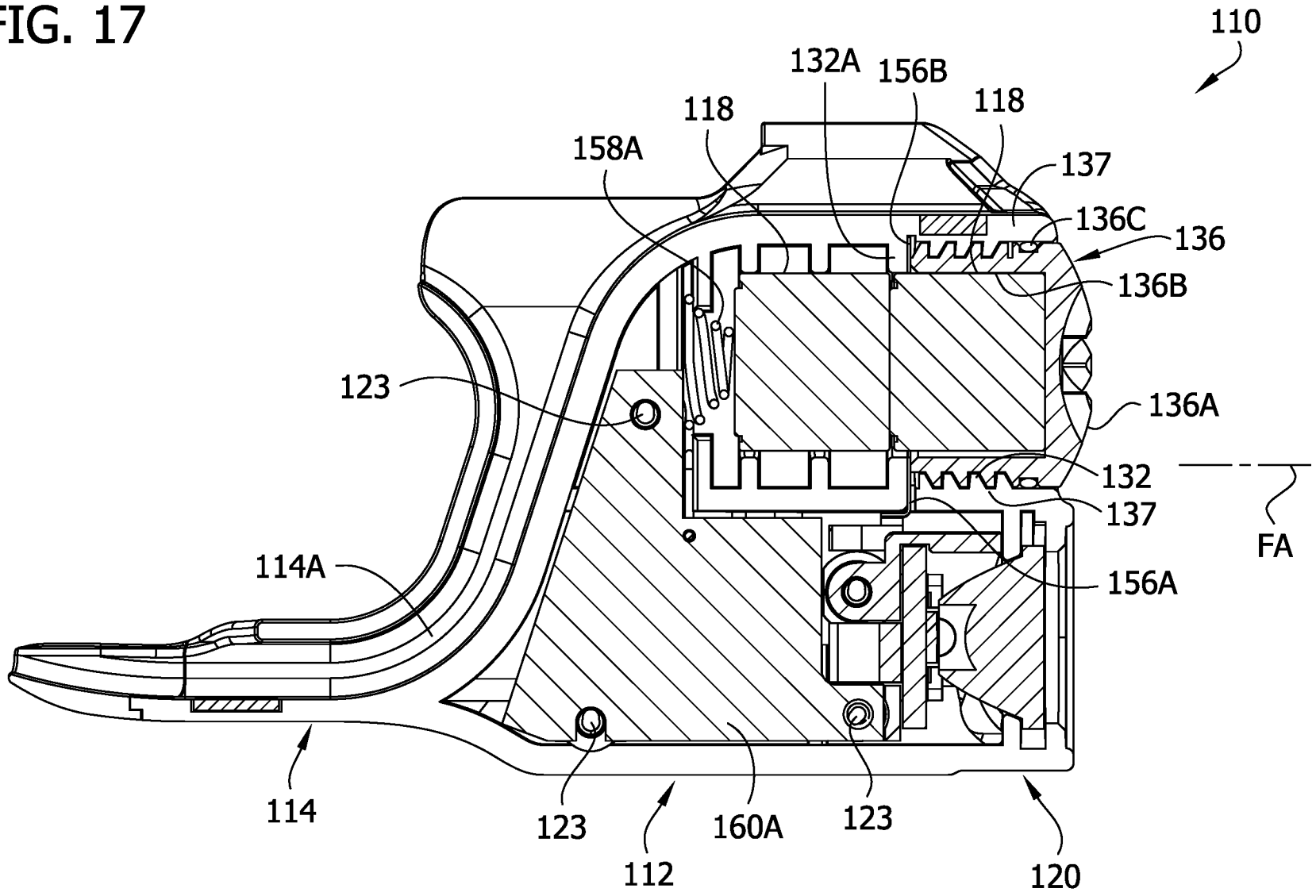
FIG. 17 is a section of the firearm accessory taken in a plane including line 17-17 of FIG. 13.

Referring to FIG. 15, the accessory body 112 includes a battery compartment 131 sized to hold one or more batteries 118. In the illustrated embodiment, two CR-1/3N 3V lithium batteries 118 are used. The accessory body 112 includes a front threaded opening 132 leading to the battery compartment 131. A front end of the threaded opening 132 is located at the front of the accessory body, and an inner end of the threaded opening is in the battery compartment 131. The inner end includes an annular flange 132A separating the threaded opening from the remainder of the battery compartment 131. A generally cylindrical cap 136 having an external thread is sized and shaped to be received in the front opening 132 and to form a threaded connection with the front opening to secure the batteries 118 in the battery compartment 131. As shown in FIGS. 16 and 17, the cap 136 has a cavity sized to at least partially receive one of the batteries 118 to provide a relatively compact arrangement. The cap 136 includes a generally circular front wall 136A and a cylindrical side wall 136B (on which the external thread is provided) extending rearward from the front wall to define the cylindrical battery cavity. The front wall 136A includes a tool socket sized and shaped for engagement by a tool (e.g., coin) to assist in rotating the cap. The cap includes an O-ring 136C that frictionally engages the threaded opening 132 to serve as a retainer to resist rotation of the cap 136 to guard against the cap inadvertently rotating out of the threaded opening.

Referring again to FIG. 15, the front threaded opening 132 is crossed at the top and bottom of the threaded opening by portions 137 of the seam between the two shell pieces 121A, 121B. The seam interrupts the thread of the threaded opening 132. The seam portions that cross the threaded opening 132 extend generally parallel to the firearm axis FA. In other embodiments, the seam portions can cross the threaded opening in other directions and/or at other locations. The internal thread in the opening 132 can be referred to broadly as a keeper in the accessory body 112 configured to engage the cap 136 to maintain the cap in position closing the battery compartment 131. Other keepers can be used to maintain the cap in the opening (e.g., a bayonet connection or lug connection, etc.) can be used without departing from the scope of the present invention.

An electrical system of the light will now be described with reference to FIGS. 15-18. The electrical system includes an electrical assembly indicated generally at 141. The electrical assembly includes components of the light head 120 such as a lens 120C, a light source 120B, and a heat sink 120D. The electrical assembly 141 also includes a circuit board structure 160 to which the light head components are secured. In the illustrated embodiment, the circuit board structure 160 includes a single circuit board 160A. In other embodiments, the circuit board structure can include other numbers of circuit boards in various configurations. The circuit board 160A is positioned centrally between the shell pieces 121A, 121B and extends along the firearm axis FA inside the accessory body 112. The circuit board 160A at least partially defines circuitry of the light 110 that places the light source 120B in electric communication with the batteries 118. The circuit board 160A supports and is in electrical communication with positive and negative electrical contacts 156, 158 for placing the batteries in electrical communication with the circuitry. The negative electrical contact 158 is provided in the form of a wire wound into a conical compression spring portion 158A that extends into the battery compartment for engaging a negative terminal of the rear battery 118. The wire 158 extends from the compression spring portion 158A to the circuit board 160A and mounts the spring portion on and electrically connects the spring to the circuit board.

The positive electrical contact 156 is provided in the form of an arm that extends from and is in electrical contact with a forward portion of the circuit board 160A. The arm 156 includes a proximal portion 156A extending along a circuitous path to an arcuate distal portion 156B of the arm. The arcuate distal portion 156B of the arm 156 includes a generally flat electrical conductor extending in an arc and having two portions 156C protruding forward relative to the remainder of the arcuate conductor. When the electrical assembly 141 is sandwiched by the two shell pieces 121A, 121B, the arcuate distal portion 156B is located in the threaded opening 132 in front of the annular flange 132A at the inner end of the threaded opening. The arrangement is such that when the cap 136 is threaded into and seated in the threaded opening 132, the inner end of the cap engages one or both of the protruding portions 156C of the positive contact 156 and presses the arcuate distal portion 156B against the flange 132A to ensure electrical contact between the cap and the positive contact. The cap 136 is made of an electrically conductive material, and the cap's engagement with the positive terminal 156 of the forward battery 118 (the side wall and/or forward end of the forward battery) places the batteries in electrical communication with the positive electrical contact 156 and thus the circuit board 160A.

Figure 18:
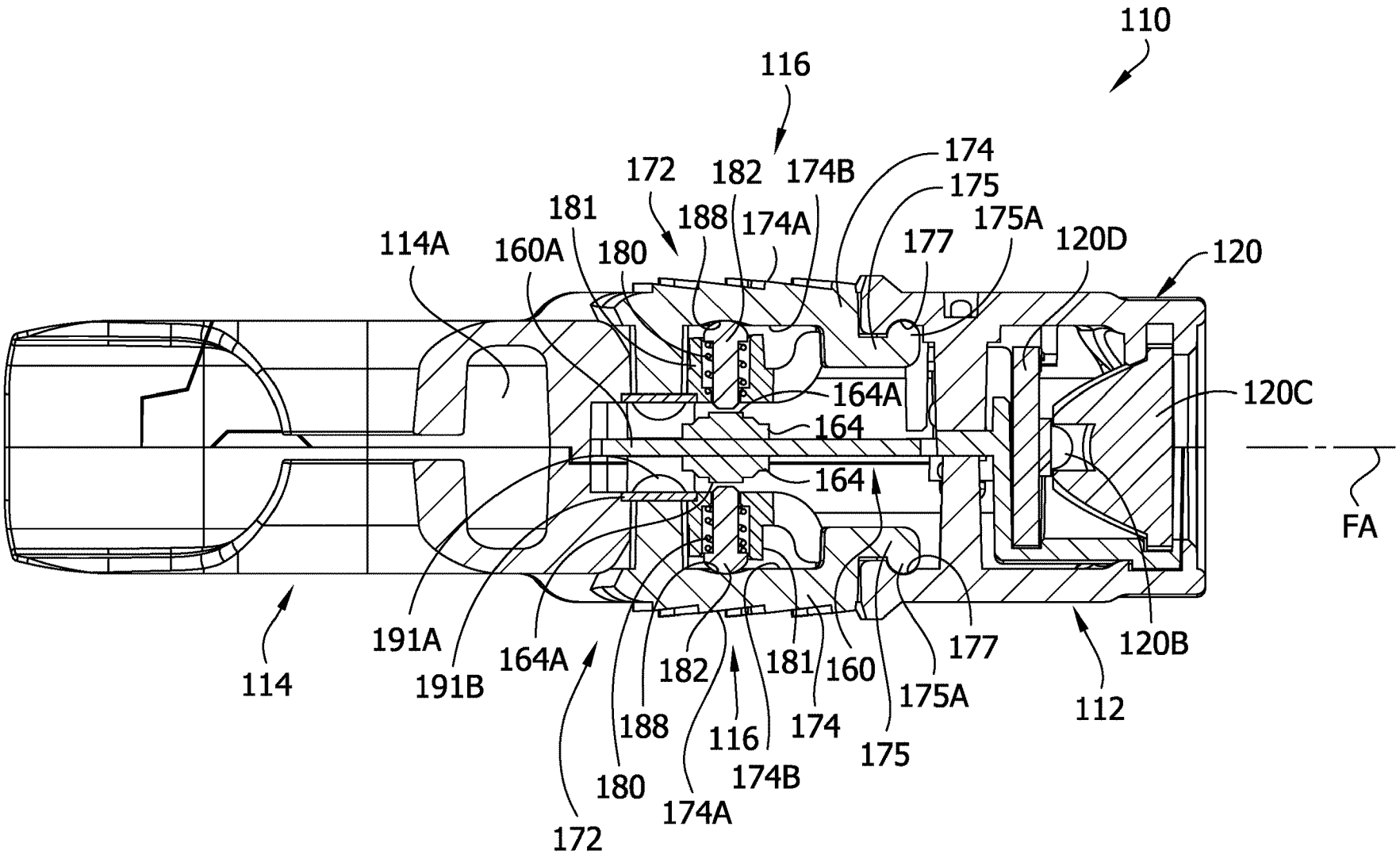
FIG. 18 is a section of the firearm accessory taken in a plane including line 18-18 of FIG. 12.

As shown in FIGS. 15, 16, and 18, the electrical assembly 141 also includes two electronic switches 164 that are parts of the switch assemblies 116. The electronic switches 164 are mounted on opposite sides of the circuit board 160A in electric communication with the circuit board. The electronic switches 164 face laterally with respect to the firearm axis FA. The switches 164 include pressure surfaces 164A responsive to pressing thereon for actuation of the electronic switches. Actuation of the electronic switches 164 can turn the light 110 on or off or otherwise change an operation of the light, such as changing modes (high, low, strobe, etc.).

The switch assemblies 116 further include respective actuators 172 on opposite sides of the accessory body 112. In the illustrated embodiment, the actuators 172 include paddles 174 (broadly, "push members") mounted on the side walls 112A, 112B of the accessory body 112. The paddles 114 have outer push surfaces 174A engageable by a hand of a user (e.g., trigger finger) and movable inward for actuating the respective electronic switches 164. In the illustrated embodiment, the push surfaces 174A have a protruding wave pattern to provide the user with tactile indication that their finger is on the push surface. As shown in FIG. 15, the paddles 174 include proximal ends having tabs 175 extending forward for pivotally connecting the paddles with respective ones of the side walls 112A, 112B of the accessory body 112. Rounded protrusions or ribs 175A extend outward from the tabs 175, which, as shown in FIG. 18, are received in concave sockets 177 on inner surfaces of the accessory body side walls 112A, 112B to form pivot connections. The paddles 174 are pivotable inward about the pivot connections toward the firearm axis FA responsive to pushing force on the push surfaces 174A. The paddles have inner major surfaces 174B facing inward toward the firearm axis FA. The actuators 172 each further include a compression spring 180 and a pin 182 (broadly "finger") inboard of the paddles 174. The pins 182 each include a head (broadly, "proximal portion") and an elongate shaft having a tip opposite the head. The pins 182 extend through the springs 180, and the pin and spring assemblies are received in cylindrical housings 181 (FIG. 15) on the side walls 112A, 112B of the accessory body 112. The pins 182 extend through openings 183 (FIG. 15) in the side walls 112A, 112B, and tips of the pins are aligned with the pressure surfaces 164A of the electronic switches 164 for pressing and thus actuating the electronic switches. Each pin 182 has a longitudinal axis that extends between the pin head and tip. The pins 182 are elongate and have lengths along the longitudinal axes greater than their widths transverse to the longitudinal axes. The longitudinal axis of the pin 182 is generally perpendicular to the push surface 174A of the corresponding paddle 174 and intersects the pressure surface 164A of the respective electronic switch 164. The inner major surfaces 174B of the paddles 174 each include a face 188 (FIG. 15) (broadly, "pin engagement portion") positioned to press on the heads of the respective pins 182. The faces 188 are concave and conformally engage the convex heads of the pins 182 while permitting some relative movement of the heads with respect to the paddles 174. The springs 180 have inner ends that engage the accessory body side wall 112A, 112B in the cylindrical housings 181 and outer ends that engage the heads of the pins 182 to bias the pins away from the electronic switches 164 and thus bias the paddles 174 away from the electronic switches. Each switch assembly 116 includes a stop 191 (FIG. 15) for limiting outward movement of the paddle 174 under the bias of the spring 180. In the illustrated embodiment, the stop 191 includes a screw 191A (broadly, "fastener") and washer 191B through which the screw extends. The screws 191A extend outward through openings 193 (FIG. 15) in the side walls 112A, 112B to the paddles 174 and are threaded into the paddles. The washers 191B are sized to engage the accessory body side walls 112A, 112B (e.g., at annular shoulders of the side walls) inside the accessory body 112 to limit outward movement of the washers and thus the screws by engagement of the screw heads with the washers.

The arrangement is such that the pins 182 act as fingers extending inward from the inner major surfaces 174B of the paddles 174, and when a paddle is pivoted inward its respective pin 182 compresses the spring 180 and presses the pressure surface 164A of the electronic switch 164, thus actuating the electronic switch. Accordingly, the paddle push surface 174A is pushable in the same direction in which the tip of the pin 182 moves (in the direction of the longitudinal axis of the pin) to actuate the electronic switch 164. When the user releases the paddle 174, the spring 180 pushes the pin 182 and paddle 174 outward to their non-actuated positions. The stops 191 limit the outward movement of the paddles 174 under the bias of the springs 180 and locate the paddles in their non-actuated positions. The construction of the switch assemblies 116 provides a relatively large effective push surface 174A that is easily pushable by the user to actuate the switch assemblies with the mechanical advantage of the pivot connection of the paddle 174 to the accessory body 112.

It will be apparent that modifications and variations are possible without departing from the scope of the invention defined in the appended claims.

As various changes could be made in the above constructions and methods without departing from the scope of the invention, it is intended that all matter contained in the above description and shown in the accompanying drawings shall be interpreted as illustrative and not in a limiting sense.

What is claimed is:

1. An electronic firearm accessory mountable on a firearm, the firearm including a rear portion, a forward portion, and a length extending therebetween, the electronic firearm accessory comprising:

an accessory body;

a mount for mounting the accessory body to the firearm;

the accessory body having a center line axis along which the length of the firearm extends when the electronic firearm accessory is mounted on the firearm;

a light source supported by the accessory body, the light source arranged to emit light in a forward direction generally parallel to the center line axis;

circuitry supported by the accessory body and in electrical communication with the light source, the circuitry including a first circuit board and a second circuit board in electrical communication with the first circuit board, the first circuit board extending generally perpendicular to the center line axis, the second circuit board extending at an angled orientation with respect to the first circuit board;

a trigger guard receiving space sized and shaped to receive a trigger guard of the firearm when the electronic firearm accessory is mounted to the firearm;

a first electronic switch mounted on the second circuit board, the first electronic switch facing in a first direction;

a second electronic switch facing in a second direction different than the first direction, the first and second directions each being at an angled orientation with respect to the center line axis; and a first paddle engageable by and movable by a user to actuate the first electronic switch, the first paddle bordering a first side of the trigger guard receiving space.

2. The electronic firearm accessory as set forth in claim 1, wherein the first paddle is connected to the accessory body by a first pivot connection, and the first paddle being pivotable with respect to the accessory body about the first pivot connection to actuate the first electronic switch, the first pivot connection being disposed forward of the trigger guard receiving space.

3. The electronic firearm accessory as set forth in claim 1, wherein the second circuit board extends generally parallel to the center line axis.

4. The electronic firearm accessory as set forth in claim 3, wherein the second circuit board is secured to the first circuit board.

5. The electronic firearm accessory as set forth in claim 1, wherein the first electronic switch is disposed rearward of the first circuit board.

6. The electronic firearm accessory as set forth in claim 5, wherein the second circuit board has a rear edge, the rear edge of the second circuit board being disposed rearward of the first circuit board.

7. The electronic firearm accessory as set forth in claim 1, further comprising a second paddle engageable by and movable by the user to actuate the second electronic switch, the second paddle bordering a second side of the trigger guard receiving space opposite the first side of the trigger guard receiving space.

8. The electronic firearm accessory as set forth in claim 7, wherein the first and second electronic switches are each spaced apart from and are each disposed rearward of the first circuit board.

9. The electronic firearm accessory as set forth in claim 8, wherein the first and second electronic switches are laterally aligned with each other such that a lateral axis extending perpendicular to the center line axis intersects both the first and second electronic switches.

10. The electronic firearm accessory as set forth in claim 9, wherein the second electronic switch is mounted on the second circuit board.

11. The electronic firearm accessory as set forth in claim 9, wherein the second circuit board has a rear edge, the rear edge of the second circuit board being disposed rearward of the first circuit board.

12. The electronic firearm accessory as set forth in claim 11, wherein the accessory body has a battery compartment sized and shaped for holding a battery therein, the first and second circuit boards being arranged relative to the battery compartment such that the first and second circuit boards are disposed rearward of the battery when the battery is held in the battery compartment.

13. The electronic firearm accessory as set forth in claim 12, wherein the circuitry includes an electrical contact arranged to engage the battery when the battery is disposed in the battery compartment to electrically connect the battery to the first circuit board, the electrical contact mounted on the first circuit board.

14. The electronic firearm accessory as set forth in claim 13, wherein the electrical contact comprises a coiled spring.

15. The electronic firearm accessory as set forth in claim 13, further comprising a light head including the light source, the light head being releasably connectable to the accessory body, the battery compartment having a front opening sized and shaped to permit the battery to be inserted into the battery compartment, the light head configured to close the front opening of the battery compartment when the light head is releasably connected to the accessory body.

16. The electronic firearm accessory as set forth in claim 15, wherein the first paddle is pivotable about a first pivot axis, the first paddle being pushable by the user to pivot the first paddle about the first pivot axis to actuate the first electronic switch, and wherein the second paddle is pivotable about a second pivot axis, the second paddle being pushable by the user to pivot the second paddle about the second pivot axis to actuate the second electronic switch.

17. The electronic firearm accessory as set forth in claim 16, wherein the trigger guard receiving space having an open rear end extending between the first paddle and the second paddle, the open rear end being sized and shaped to permit the trigger guard to move through the open rear end to position the trigger guard in the trigger guard receiving space, and wherein the trigger guard receiving space has an open top and an open bottom, the open top being sized and shaped to permit the trigger guard to extend out of the trigger guard receiving space through the open top when the trigger guard is disposed in the trigger guard receiving space, and the open bottom being sized and shaped to permit the trigger guard to extend out of the trigger guard receiving space through the open bottom when the trigger guard is disposed in the trigger guard receiving space.

18. The electronic firearm accessory as set forth in claim 17, further comprising a first spring biasing the first paddle away from the first electronic switch and a second spring biasing the second paddle away from the second electronic switch.

19. The electronic firearm accessory as set forth in claim 18, wherein the mount comprises a firearm rail mount configured to connect the electronic firearm accessory to a rail of the firearm.

20. An electronic firearm accessory mountable on a firearm, the firearm including a rear portion, a forward portion, and a length extending therebetween, the electronic firearm accessory comprising:

an accessory body;

a mount for mounting the accessory body to the firearm;

the accessory body having a center line axis along which the length of the firearm extends when the electronic firearm accessory is mounted on the firearm;

a light source supported by the accessory body, the light source arranged to emit light in a forward direction generally parallel to the center line axis;

circuitry supported by the accessory body and in electrical communication with the light source, the circuitry including a first circuit board and a second circuit board in electrical communication with the first circuit board, the first circuit board extending generally perpendicular to the center line axis, the second circuit board extending at an angled orientation with respect to the first circuit board, the second circuit board having a rear edge, the rear edge of the second circuit board being disposed rearward of the first circuit board;

a trigger guard receiving space sized and shaped to receive a trigger guard of the firearm when the electronic firearm accessory is mounted to the firearm;

a first electronic switch mounted on the second circuit board, the first electronic switch being disposed rearward of the first circuit board, the first electronic switch facing in a first direction;

a second electronic switch facing in a second direction different than the first direction, the second electronic switch being disposed rearward of the first circuit board, the second electronic switch being spaced apart from the first electronic switch;

a first paddle engageable by and movable by a user to actuate the first electronic switch, the first paddle bordering a first side of the trigger guard receiving space; and a second paddle engageable by and movable by the user to actuate the second electronic switch, the second paddle bordering a second side of the trigger guard receiving space opposite the first side of the trigger guard receiving space.

21. The electronic firearm accessory as set forth in claim 20, wherein the accessory body has a battery compartment sized and shaped for holding a battery therein, the first and second circuit boards being arranged relative to the battery compartment such that the first and second circuit boards are disposed rearward of the battery when the battery is held in the battery compartment.

22. The electronic firearm accessory as set forth in claim 21, further comprising a light head including the light source, the light head being releasably connectable to the accessory body, the battery compartment having a front opening sized and shaped to permit the battery to be inserted into the battery compartment, the light head configured to close the front opening of the battery compartment when the light head is releasably connected to the accessory body.

23. The electronic firearm accessory as set forth in claim 22, wherein the first paddle is pivotable about a first pivot axis, the first paddle being pushable by the user to pivot the first paddle about the first pivot axis to actuate the first electronic switch, the first paddle having a rear end rearward of the first pivot axis and arranged to move toward the center line axis when the user pivots the first paddle to actuate the first electronic switch, and wherein the second paddle is pivotable about a second pivot axis, the second paddle being pushable by the user to pivot the second paddle about the second pivot axis to actuate the second electronic switch, the second paddle having a rear end rearward of the second pivot axis and arranged to move toward the center line axis when the user pivots the second paddle to actuate the second electronic switch.

24. The electronic firearm accessory as set forth in claim 23, wherein the trigger guard receiving space having an open rear end extending between the first paddle and the second paddle, the open rear end being sized and shaped to permit the trigger guard to move through the open rear end to position the trigger guard in the trigger guard receiving space, and wherein the trigger guard receiving space has an open top and an open bottom, the open top being sized and shaped to permit the trigger guard to extend out of the trigger guard receiving space through the open top when the trigger guard is disposed in the trigger guard receiving space, and the open bottom being sized and shaped to permit the trigger guard to extend out of the trigger guard receiving space through the open bottom when the trigger guard is disposed in the trigger guard receiving space.

25. The electronic firearm accessory as set forth in claim 24, further comprising a first spring biasing the first paddle away from the first electronic switch and a second spring biasing the second paddle away from the second electronic switch.

26. The electronic firearm accessory as set forth in claim 25, wherein the mount comprises a firearm rail mount configured to connect the electronic firearm accessory to a rail of the firearm.

* * * * *